US006328102B1

(12) United States Patent
Dean

(10) Patent No.: US 6,328,102 B1
(45) Date of Patent: Dec. 11, 2001

(54) METHOD AND APPARATUS FOR PIEZOELECTRIC TRANSPORT

(76) Inventor: John C. Dean, 4805 Island Dr., Midland, TX (US) 79707

( * ) Notice: Subject to any disclaimer, the term of this patent is extended or adjusted under 35 U.S.C. 154(b) by 0 days.

(21) Appl. No.: 09/134,463

(22) Filed: Aug. 14, 1998

Related U.S. Application Data

(63) Continuation-in-part of application No. 08/753,717, filed on Nov. 27, 1996.
(60) Provisional application No. 60/007,846, filed on Dec. 1, 1995.

(51) Int. Cl.[7] ..... E21P 43/00
(52) U.S. Cl. ..... 166/248; 166/249; 166/177.6
(58) Field of Search ..... 166/248, 249, 166/302, 65.1, 177.1, 177.2, 177.6

(56) References Cited

U.S. PATENT DOCUMENTS

| | | |
|---|---|---|
| Re. 30,738 | 9/1981 | Bridges et al. . |
| 1,784,214 | 12/1930 | Workman . |
| 2,118,669 | 5/1938 | Grebe . |
| 3,137,347 | 6/1964 | Parker . |
| 3,141,099 | 7/1964 | Brandon . |
| 3,149,672 | 9/1964 | Orkiszewski et al. . |
| 3,189,088 | 6/1965 | Cronberger . |
| 3,211,220 | 10/1965 | Saapuu . |
| 3,387,195 | 6/1968 | Piccand . |
| 3,417,823 | 12/1968 | Faris . |
| 3,507,330 | 4/1970 | Gill . |
| 3,530,936 | 9/1970 | Gunderson . |
| 3,547,193 | 12/1970 | Gill . |
| 3,585,489 | 6/1971 | Pelly . |
| 3,605,888 | 9/1971 | Crowson et al. . |
| 3,614,986 | 10/1971 | Gill . |
| 3,620,300 | 11/1971 | Crewson . |
| 3,642,066 | 2/1972 | Gill . |
| 3,659,168 | 4/1972 | Salihi et al. . |
| 3,718,186 | 2/1973 | Brandon . |
| 3,766,980 | 10/1973 | Kern . |
| 3,849,719 | 11/1974 | Geiersbach et al. . |

(List continued on next page.)

OTHER PUBLICATIONS

*Vibrations and Waves in Physics* by Ian G. Main (Second Edition), pp. 73–75; 84–86; 262–267.
Encyclopedic Dictionary of Exploration Geophysics by Robert E. Sheriff, p. 222.

(List continued on next page.)

*Primary Examiner*—William Neuder
(74) *Attorney, Agent, or Firm*—Melvin A. Hunn

(57) ABSTRACT

The present invention is directed to a method of utilizing the piezoelectric effect to transport a target substance within an earth formation. An earth formation is identified which bears a target substance. The piezoelectric properties of the earth formation are examined in order to determine the extent of the piezoelectric effect and to determine any optimum frequency of excitation. A voltage is applied to a particular portion of an earth formation in order to develop mechanical stress in the earth formation utilizing the piezoelectric property. The mechanical stress effects the local temperature and permeability of the target substance within the earth formation. A combination of excitation due to the electric field, mechanical stress, the temperature increase, serves to alter the permeability in a desired manner in order to liberate greater amounts of target substance from the earth formation, and to facilitate removal of the target substance utilizing conventional technologies such as pumps. Alternatively, and supplementally, a mechanical vibration and/or sonic energy source may be utilized to develop mechanical and electrical forces on the subsurface earth formation, to alter permeability of a target substance.

101 Claims, 14 Drawing Sheets

U.S. PATENT DOCUMENTS

| | | | | |
|---|---|---|---|---|
| 3,862,662 | | 1/1975 | Kern . | |
| 4,010,799 | | 3/1977 | Kern et al. . | |
| 4,013,937 | | 3/1977 | Pelly et al. . | |
| 4,038,592 | | 7/1977 | Stummer . | |
| 4,050,007 | | 9/1977 | Gross et al. . | |
| 4,084,639 | | 4/1978 | Todd . | |
| 4,096,557 | | 6/1978 | Schwarz . | |
| 4,116,273 | | 9/1978 | Fisher et al. . | |
| 4,124,483 | | 11/1978 | Christenson . | |
| 4,140,179 | | 2/1979 | Kasevich et al. . | |
| 4,140,180 | | 2/1979 | Bridges et al. . | |
| 4,196,329 | | 4/1980 | Rowland et al. . | |
| 4,199,025 | | 4/1980 | Carpenter . | |
| 4,307,444 | | 12/1981 | Stacey et al. . | |
| 4,376,598 | | 3/1983 | Brouns et al. . | |
| 4,382,469 | | 5/1983 | Bell et al. . | |
| 4,437,518 | * | 3/1984 | Williams | 166/248 |
| 4,449,585 | | 5/1984 | Bridges et al. . | |
| 4,466,484 | | 8/1984 | Kermabon . | |
| 4,473,114 | | 9/1984 | Bell et al. . | |
| 4,489,782 | | 12/1984 | Perkins . | |
| 4,498,535 | | 2/1985 | Bridges . | |
| 4,524,827 | | 6/1985 | Bridges et al. . | |
| 4,545,435 | | 10/1985 | Bridges et al. . | |
| 4,628,425 | | 12/1986 | Venturini et al. . | |
| 5,101,899 | | 4/1992 | Hoskins et al. | 166/248 |
| 5,282,508 | * | 2/1994 | Ellingsen et al. | 166/249 |
| 5,323,855 | | 6/1994 | Evans | 166/248 |
| 5,449,889 | | 9/1995 | Samadzja | 219/695 |

OTHER PUBLICATIONS

The Journal of Canadian Petroleum Technology (*Oil Production response to in situ electrical resistance heating* (*ERH*) by R.A. Wattenbarger and F.W. McDougal Texas A & M University, pp. 45–50.

Pacific Oil World—Electromagnetic Well Stimulation at White Wolf, by Bill Rintoul, p. 11.

Society of Petroleum Engineers—Electrical Heating of Oil Reservoirs: Numerical Simulation and Field Test Results, by J.O.S. Pizarro, SPE Petrobras and O.V. Trevisan, SPE, U. of Campinas, Oct. 1990, pp. 1320–1326.

Manuscript received Sep. 20, 1972 entitled The Application of the Theory of Heterogeneous Dielectrics to Low Surface Area Soil Systems by Douglas C. Pearce, William H. Hulse, Jr. and John W. Walker, pp. 167–170.

Reservoir Simulation of In Situ Electromagnetic Heating of Heavy Oils; a dissertation by Eul Soo Kim, dated Aug. 1987 pp.iii–viii, pp. 91–101.

Electric Power Systems Research, 16 (1988) Nonlinear Modeling of Magnetic Saturation and Hysteresis in an Electromagnetic Device, by A. Keyhani and S.M. Miri pp. 15–23.

J. Phys. A: Gen. Phys. vol. 5, Jul. 1972, by P.G. Wright, Revised thermodynamic realtions ofr λtransitions in mixtures II. Special relations for Curie points and Néel points pp. 1015–1017.

Society of Petroleum Engineers, by J.R. Fanchi, Marathon Oil Co., pp. 189–200.

A Thesis by Louis Edward Doublet entitled *Evaluation of Electromagnetic Stimulation of Texas Heavy Oil Reservoirs*, pp.iii–vii, pp. 62–64, pp. 68–72, Dec. 1988.

Society of Petroleum Engineers of AIME dated Oct. 1984, An EPT Interpretation Procedure and Application in Freshwater, Shaly Oil Sands, by J.M. Delano, Jr. and R.P. Wharton.

Society of Petroleum Engineers, Improved Calculation of Oil Production Response to Electrical Resistance Heating (ERH), by B.A. Baylor, J.B. Maggard and R.A. Watenbarger, Texas A & M Univ., dated 1990 pp. 177–187.

Third Unitar Conference on Heavy Crude and Tar Sands, Chapter 58, *Electromacnetic Stimulation of Heavy–Oil Wells*, by J.E. Bridges and G.C. Sresty, IIT Research Institute, Illinois, pp. 615–622.

Third Unitar Conference on Heavy Crude and Tar Sands, Chapter 75, *In Situ RF Heating for Oil Sand and Heavy Oil Deposits*, by J.E. Briggs, G.C. Sresty and H. Dev., IIT Research Institute, Illinois, USA, pp. 797–804.

Third Unitar Conference on Heavy Crude and Tar Sands, Chapter 88, *Heavy Oil Recovery Methods—A Classification System*, by C.D. Cornelius, pp. 943–951.

Third Unitar Conference on Heavy Crude and Tar Sands, Chapter 59, *Lambda Technology—A New Approach to Improved Heavy Oil Recovery*, by M.A. de Four, J.S. Broz, and W.T. Savery, Petrotec Systems, Inc., pp. 623–636.

Physics Letters, vol. 88A, No. 6, *Vibronic Ferroelectrics in the field of a Strong Electromagnetic Wave*, dated Mar. 22, 1982, pp. 321–322.

J. Appl. Phys. 50(1), Jan. 1979, by L. Lanotte, C. Luponio and F. Porreca, Spontaneous vibrational modes excited in ferromagnetics by reversible magnetostriction, pp. 438–443.

Engineering Solutions, by Marelco Power Systems, Inc., Howell, Michigan, Discussion of Theory and Practice for Transformers, Reactors & Inductors, pp. 2–3.

Oil & Gas Journal, Nov. 14, 1988, Electromagnetic reservoir stimulation shows promise in Brazil, author unknown, pp. 106–107.

Transactions on Magnetics, vol. Mag–23, No. 5, Sep. 1987, Magnetostrictive Vibration of Electrical Steel Sheets Under a Non–Sinusoidal Magnetizing Condition, by Tadashi Sasaki, et al., pp. 3077–3079.

J. Appl. Phys. 65(2), Jan. 15, 1989, by Amr M. Shaarawi and Ioanni M. Besieris, Localized energy pulse trains launced from an open, semi–infinite circular waveguide, pp. 805–813.

* cited by examiner

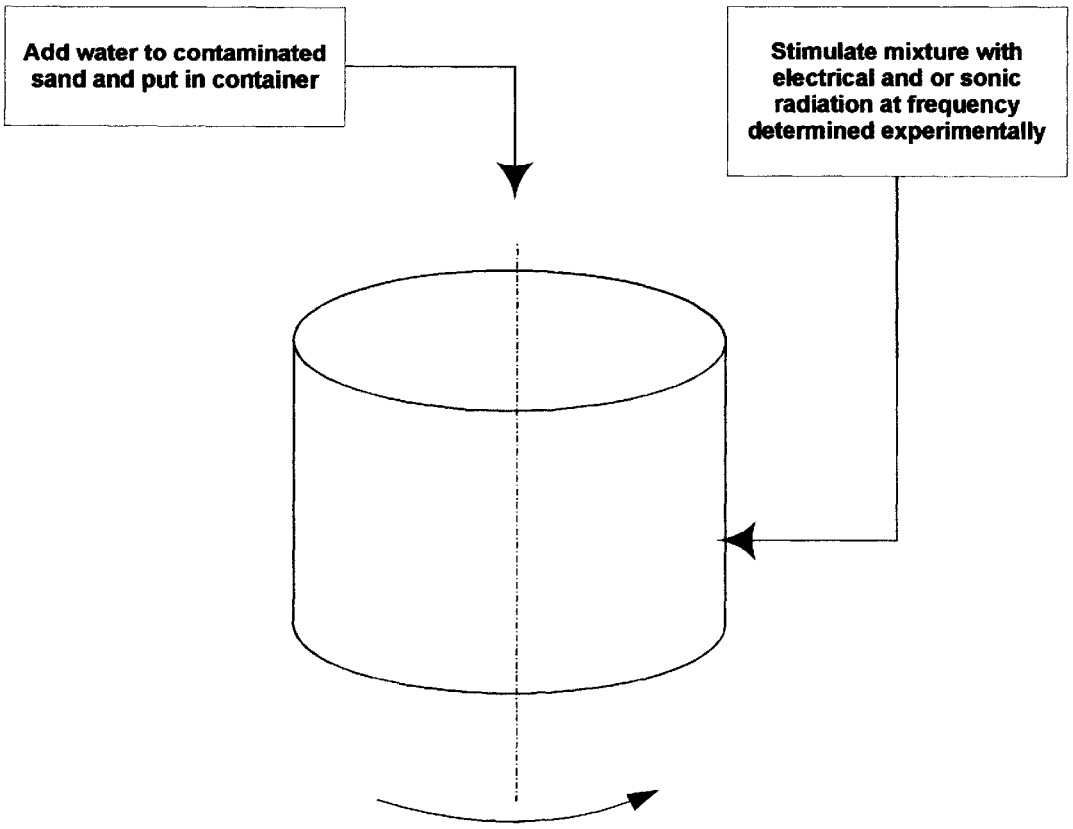

FORCES ACTING TO SEPARATE OIL FROM SAND:

1. Piezoelectric effect weakens cohesive forces at the sand grain and oil interface with mechanical and electrical stress.
2. Difference in density between oil and water.
3. Polarity of water molecule which causes the water to be attracted and repulsed from the changing dipole of stimulated sand increasing agitation.
4. Centrifuge hastens separation of oil from sand and water.

Figure 8

METHOD AND APPARATUS FOR PIEZOELECTRIC TRANSPORT

CROSS-REFERENCE TO RELATED APPLICATIONS

This application is a continuation-in-part of the following co-pending patent application:

1. U.S. patent application Ser. No. 08/753,717, filed Nov. 27, 1996, entitled "Method and Apparatus for Improved Tertiary Hydrocarbon Recovery."

This Application claims the benefit, through the above-identified patent application, of the filing date under 35 USC §§119 and/or 120, and 37 CFR §§1.60 and/or 1.78 to the following U.S. regular patent application and U.S. provisional patent application:

1. U.S. provisional patent application Ser. No. 60/007,846, filed on Dec. 1, 1995, entitled "Method and Apparatus for Tertiary Hydrocarbon Recovery"; and
2. U.S. patent application Ser. No. 08/753,717, filed Nov. 27, 1996, entitled "Method and Apparatus for Improved Tertiary Hydrocarbon Recovery."

BACKGROUND OF THE INVENTION

1. Field of the Invention

This invention relates generally to the transport of a target substance from an earth formation, and may find commercial application in the recovery of hydrocarbons from a wellbore or in environmental clean-up operations.

2. Description of the Prior Art

Hydrocarbons are likely to remain a critical component of this nation's economy. While the oil and gas industry expends considerable sums in the exploration and development of new fields, the industry also recognizes that a large amount of unproduced hydrocarbons remain in formations which have already been discovered and produced. Many older formations have been subjected to workover operations, wherein the hydrocarbon-bearing formations were fractured, water-flooded, and subjected to various chemical treatments. Even in those formations in which substantial sums have been expended on secondary recovery operations, the industry recognizes that substantial deposits remain. This has given rise to a tertiary recovery industry, wherein various techniques are utilized to stimulate the formation and generate the production of additional hydrocarbons therefrom. For example, a variety of techniques exist in which the formation is subjected to electrical or thermal stimulation which allows for the additional production of hydrocarbons. For example, various prior art techniques include the stimulation of the formation using microwave radiation. Alternatively, electrodes can be placed in the formation in order to stimulate production utilizing electrical currents. Alternatively, a thermal element can be located within the wellbore which elevates the formation temperature, resulting in increased production, in particular in fields which have hydrocarbon deposits which tend to congeal and clog the flow pathways and wellbore.

The present invention is also directed to environmental clean-up operations of both subsurface and surface locations. In the prior art, considerable amounts are expended to contain and clean-up undesirable contamination which may reside in a subterranean or surface location. Contaminates may include extremely hazardous materials, such as toxic substances, as well as less hazardous materials such as petroleum based chemicals. Prior art clean-up operations are often very expensive operations to undertake and may involve the excavation, removal, and replacement of surface earth formations. Such projects are of a massive scale, requiring considerable investment of manpower, equipment, and time. For spills that occur in relatively populous regions, there are very few options, since the contaminate soil may present long term hazards to the aquifer or other water supplies adjacent or beneath the contaminated soil. Any improvement in technology that may reduce the investment in dollars, manpower, equipment, and time would be welcome in the industry.

SUMMARY OF THE PRESENT INVENTION

It is one objective of the present invention to provide a method for utilizing the piezoelectric effect for aiding in the transporting of target substances within an earth formation.

It is yet another objective of the present invention to provide a method which utilizes either or both of the direct and the converse piezoelectric effect to mechanically stimulate at least one earth formation to increase the permeability of the medium, increase the local temperature in the medium, and to enhance the permeability of a preselected volume of the medium.

Additionally, it is another objective of the present invention to provide a method for piezoelectric-induced transport within a particular earth formation, in a manner which allows an operator to control the directional is orientation of an enhanced permeability within the earth formation.

Yet another objective of the present invention is to provide a method of utilizing a piezoelectric effect to sequentially deform an earth medium and produce the effect of a peristaltic fluid pump to directionally transport fluids within a target formation.

These and other objectives are achieved as is now described. A method is provided for enhancing the transport of a target substance in a particular surface and/or subsurface earth formation. The method includes a number of method steps. An earth formation is identified which has a particular, desirable piezoelectric property. The earth formation bears a target substance which is to be separated or removed from the earth's formation. In one commercial implementation, the target substance may include hydrocarbons or other downhole substances which are commercially valuable or which should be removed for other reasons. Either both of the direct and converse piezoelectric effects are utilized. When the converse piezoelectric effect is utilized, a voltage is applied to at least a particular portion of the earth formation. The voltage develops mechanical stress in the particular earth formation utilizing the piezoelectric property, in particular utilizing the converse piezoelectric effect. The mechanical stress causes changes in the earth's formation which facilitate removal of the target substance. Alternatively, or supplementally, the direct piezoelectric effect may be utilized by supplying a vibration or sonic energy source mechanically coupled to the earth formation. Finally, at least one removal process is utilized in combination with utilization of the piezoelectric property to transport at least a portion of the target substance away from the particular earth formation. In the context of the commercial implementation of hydrocarbon recovery, the removal process may be any conventional or novel process for directing hydrocarbons to the surface, and may include pumping or water flooding operations.

In one preferred embodiment of the present invention, the utilization of the converse piezoelectric effect generates mechanical stress in the earth formation which alters the permeability of the earth formation. Additionally, the mechanical stress develops a local temperature increase in the affected formation. The impact of the electrical field, mechanical stress, and the temperature increase results in changes which affect the permeability of the target substance and which result in an advantageous increase in the permeability which allows the target substance to be removed from the earth formation. This may be supplemented by the application of vibratory or sonic energy to the formation.

In alternative embodiments of the invention, the piezoelectric effect may be applied to the earth formation in a manner which develops permeability which has a controllable directional orientation. This is accomplished by applying either a stimulating voltage and/or a vibration or sonic source to the earth formation in a manner which either varies the piezoelectric effect with respect to time or location within the surface or subsurface earth formation. In this manner, the permeability may be controlled in time and direction in order to allow for preferential flow of subterranean fluids which may carry the target substance. Additionally, and alternatively, a plurality of stimulating energies may be applied in a predetermined pattern with respect to time to a plurality of portions of surface or subsurface earth formations in order to sequentially deform the earth formations in a manner which evacuates fluid due to a resulting peristaltic pump fluid action.

In the preferred embodiment of the present invention, analysis is performed of the surface or subsurface earth formation which contains a target substance in order to determine the presence of a piezoelectric effect and the magnitude of the piezoelectric effect within the formation. Additionally, the earth formation which contains the target substance may be studied in order to determine the one or more resonant frequencies associated with the material. The resonant frequencies may be utilized during stimulation operations in order to maximize the application of the piezoelectric effect to the earth formation. The determination of the optimum frequency or frequencies of operation can be performed in a classical scientific manner by applying a range of energizing frequencies to the target substance in order to determine the optimum frequency of operation.

Additionally, and alternatively, the optimization of the piezoelectric excitation of surface or subsurface earth formation may be conducted during stimulation operations, in a relatively conventional feedback system. In accordance with this alternative embodiment, the amount of target substance released from the formation is monitored during stimulation operations in order to determine the one or more optimum frequencies of stimulation. The stimulation process is adjusted in response to this feedback to change the frequency of stimulation in order to optimize the production of target substance from the earth formations.

In yet another embodiment, contaminated soil (such as sand) may be placed in a centrifuge-type device and water may be added. The resulting mixture may be subjected to a direct and/or converse piezoelectric energizing source while the centrifuge is being operated. The piezoelectric effect weakens the cohesive forces at the sand-oil interface. The combination of mechanical and electrical stress further enhances a separation of oil, sand, and water.

BRIEF DESCRIPTION OF THE DRAWINGS

For a better understanding of the invention as well as other objectives and features, reference is made to the following description which is to be read in conjunction with the accompanying drawing wherein:

FIG. 8 is utilized to explain utilization of the present invention for environmental clean-up operations;

DETAILED DESCRIPTION OF THE INVENTION

Figure 1:
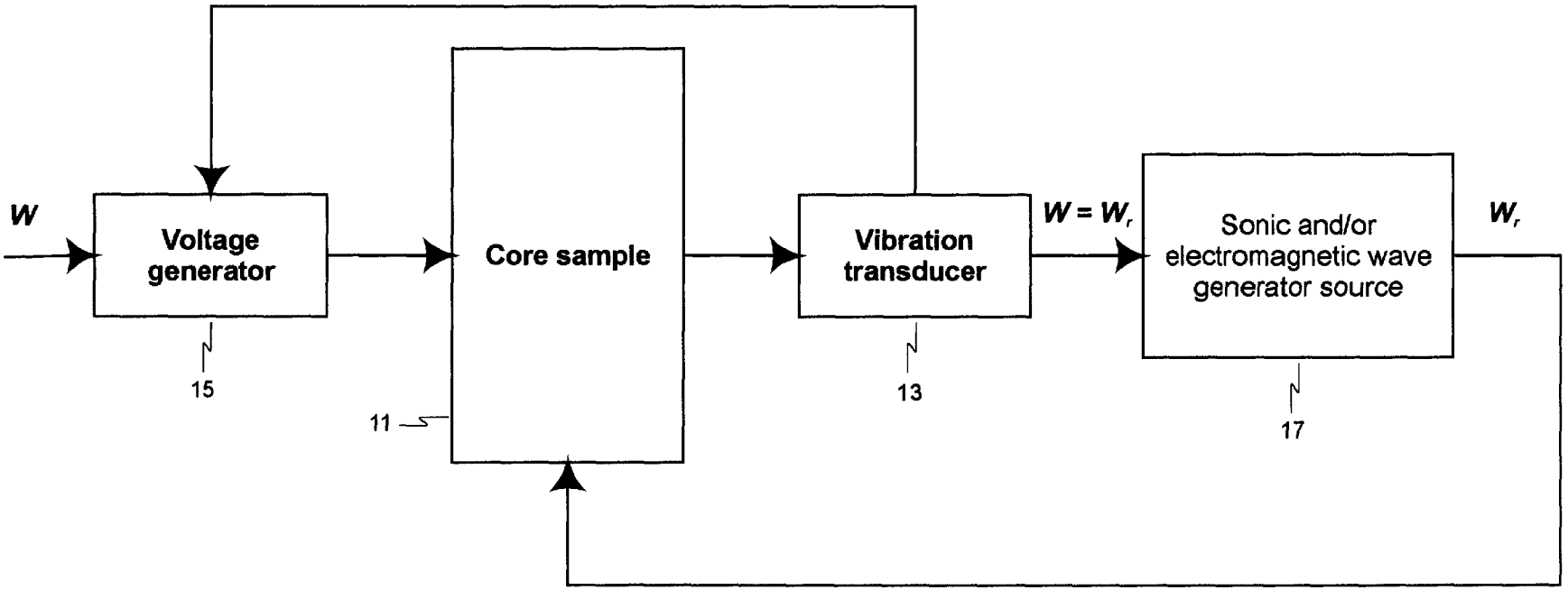
FIG. 1 is block diagram representation of the testing process utilized to determine the operating attributes of an energizing source for a converse piezoelectric effect which optimizes production of hydrocarbons from a particular formation.

This invention relates to a method which facilitates the movement of any fluid through any geologic or earth formation or medium that possesses piezoelectric properties. Application of the process to such a medium results in the following:

1. An increase in the permeability of the medium.
2. An increase in the temperature of the medium.
3. The capability to enhance the permeability of any preselected volume of the medium.
4. The capability to control the directional orientation of the enhanced permeability within the medium.
5. The capability to sequentially deform the medium in effect making the medium a peristaltic fluid pump.
6. The capability to mechanically and electrically agitate the medium to overcome the cohesive forces between the fluid and the medium.
7. The capability to log the medium in terms of the type and amount of fluid within it.

The process operates on the piezoelectric components of the medium by using the direct and/or converse piezoelectric effect singly or in combination. The application of a mechanical stress to a piezoelectric crystal produces an electric polarization which is proportional to this stress. If the crystal is isolated, this polarization manifests itself as voltage across the crystal, and if the crystal is shortcircuited, a flow of charge can be observed during loading. Conversely, application of a voltage between certain faces of the crystal produces a mechanical distortion of the material. This reciprocal relationship is known as the piezoelectric effect. The phenomenon of generation of a voltage under mechanical stress is referred to as the "direct piezoelectric effect," and the mechanical strain produced on the crystal under electric stress is called the "converse piezoelectric effect." In general, this electromechanical coupling is very sensitive as to how the crystal is oriented with respect to the orientation of the applied electric field or mechanical stress. This property is also exploited by the process of the present invention.

The piezoelectric strains that can be induced by a static electric field are small. Larger strains can be obtained when a piezoelectric crystal is driven by an alternating voltage, the frequency of which is equal to a mechanical resonance frequency of the crystal. The vibrating crystal reacts back on itself through the direct piezoelectric effect. Further increases in the amplitude of vibration are realized by stimulating the vibrating crystal with additional electromagnetic or sonic radiation tuned to match the achieved resonant frequency of the crystal. Sonic radiation is a one method to cause mechanical deformation of the piezoelectric crystal. The amplitude of vibration is maximized causing fatigue fractures either within the structure of the crystal or along grain boundaries.

The necessary condition for the piezoelectric effect is the absence of a center of symmetry in the crystal structure. Of the 32 crystal classes, 21 lack a center of symmetry, and with the exception of one class, all of these are piezoelectric. In the crystal class of lowest symmetry, any type of stress generates an electric polarization, whereas in crystals of higher symmetry, only particular types of stress can produce a piezoelectric polarization. For a given crystal, the axis of polarization depends upon the type of the stress. There is no crystal class in which the piezoelectric polarization is confined to a single axis. In several crystal classes, however, it is confined to a plane.

The converse piezoelectric effect is a thermodynamic consequence of the direct piezoelectric effect. When a polarization P is induced in a piezoelectric crystal by an externally applied electric field E, the crystal suffers a small strain S which is proportional to the polarization P. In crystals with a normal dielectric behavior, the polarization P is proportional to the electric field E, and hence the strain is proportional to this field E.

The relation of the six components $T_j$ of the stress tensor (three compressional components and three shear components) to the three components $P_i$ of the polarization vector can be described by a matrix of 18 piezoelectric moduli $d_{ij}$. The same scheme ($d_{ij}$) also relates the three components $E_i$ of the electric field to the six components $S_j$ of the strain.

The direct effect is then given by Eq. (1).

$$P_i=-\Sigma_{j=1}^{6}d_{ij}T_j i=1,2,3 \quad (1)$$

The converse effect is given by Eq. (2).

$$S_j=\Sigma_{i=1}^{3}d_{ij}E_i j=1,2,\ldots,6 \quad (2)$$

An analogous matrix ($e_{ij}$) relates the strain to the polarization as in Eq. (3)

$$P_i=\Sigma_{j=1}^{6}e_{ij}S_j i=1,2,3 \quad (3)$$

and the electric field to the stress as in Eq. (4).

$$T_j=-\Sigma_{i=1}^{3}e_{ij}E_i j=1,2,\ldots,6 \quad (4)$$

The matrices ($d_{ij}$) and ($e_{ij}$) are not independent, but are related by expressions involving the elasticity tensor $c_{jh}^{E}$ (for constant electric field E), as in Eq. (5).

$$e_{mh}=\Sigma_{j=1}^{6}d_{mj}c_{jh}^{E} m=1,2,3 h=1,2,\ldots,6 \quad (5)$$

The number of independent matrix elements $d_{ij}$ or $e_{ij}$ depends upon the symmetry elements of the crystal. For the lowest symmetry, all 18 matrix elements are independent, whereas piezoelectric classes of higher symmetry can have as few as one independent element in the matrix ($d_{ij}$). The matrix takes its simplest form if the natural symmetry axes of the crystal are chosen for the coordinate system. The most likely piezoelectric medium for this application is quartz or silicon dioxide. Quartz belongs to the trigonal system, and the point group is 32. Components of the d-constant are $d_{11}=-d_{12}$, $d_{14}=-d_{25}$, and $d_{26}=-2d_{11}$; those of the e-constant are $e_{11}=-e_{12}$, $e_{14}=-e_{25}$, and $e_{26}=-e_{11}$. There are two independent components in either d or e. For quartz, these values are $d_{11}=2.3$ pCN$^{-1}$, $d_{14}=-0.067$ pCN$^{-1}$, $e_{11}=0.17$ Cm$^{-2}$, $e_{14}=0.04$ Cm$^{-2}$.

One excellent resource for obtaining an overview of piezoelectrinc principle is the publication entitled "An American National Standard: IEEE Standard on Piezoelectricity" ANSI/IEEE Publication No. Std. 176–198. Another resource which provides an overview of the constants of various crystals is the publication entitled "The Constants of Alpha Quartz" by Roger Ward, which is reprinted in the 38th Annual Frequency Control Symposium, 22–31, by the IEEE.

The direct piezoelectric effect makes a crystal a generator, and the converse effect makes it a motor. Consequently, a piezoelectric crystal has many properties in common with a motor-generator. For example, the electrical properties, such as the dielectric constant, depend upon the mechanical load; conversely, the mechanical properties, such as the elastic constants, depend upon the electric boundary conditions. The electromechanical coupling factor k can be defined as follows. Suppose electrodes are attached to a piezoelectric crystal and connected to a battery, the ratio of the energy stored in mechanical form to the electrical energy delivered by the battery is equal to $k^2$. In general, k ranges from below 1 to about 30%. In quartz, the coupling is roughly 10%.

In quartz, a stress of 1 newton/m applied along the diad axis produces a polarization of about $2\times10^{-12}$ coulombs/m$^2$ along the same axis. Conversely, an electric field of $10^4$ volts/m produces a strain of about $2\times10^{-8}$. The piezoelectric strains that can be induced by a static electric field are very small. Much larger strains can be obtained when a piezoelectric crystal is driven by an alternating voltage, the frequency of which is equal to the mechanical resonance frequency of the crystal. The vibrating crystal reacts back on the circuit through the direct piezoelectric effect. When resonance occurs, the frequency of excitation matches the natural mechanical resonance of the piezoelectric medium giving rise to a huge increase in response in terms of strain and, therefore, stress within the medium.

Figure 9:
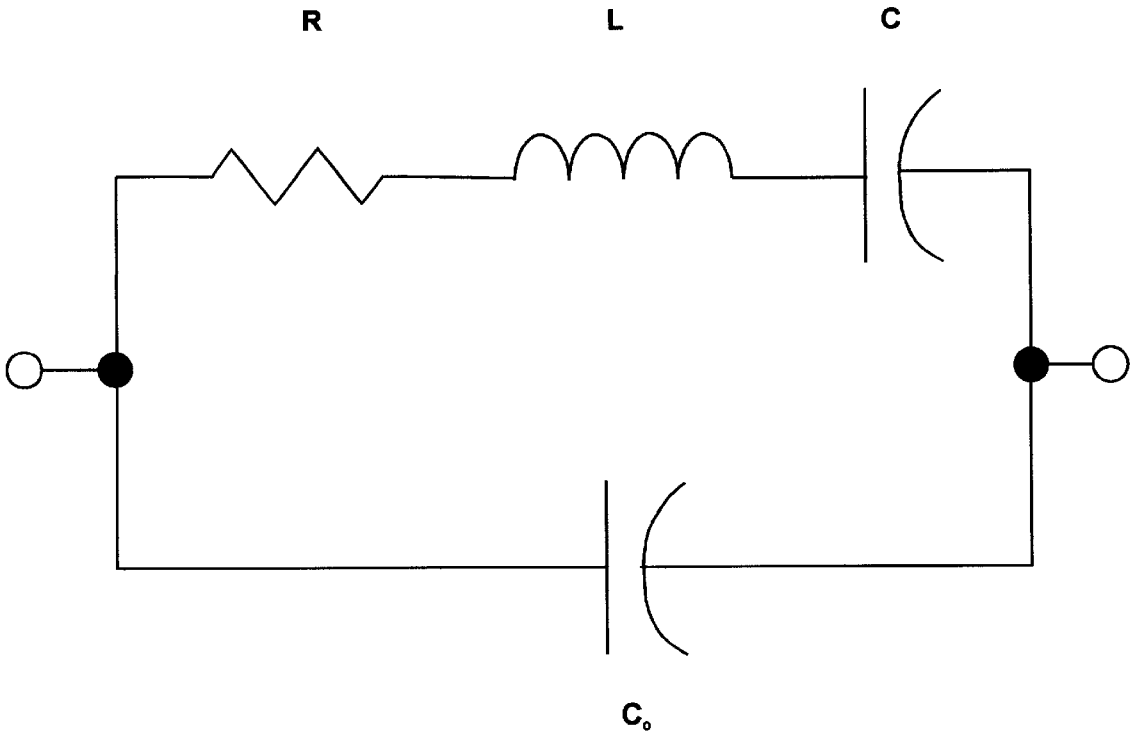
FIG. 9 is a pictorial representation an equivalent circuit which is utilized to explain the resonance of a piezoelectric material.

In the range of mechanical resonance, this reaction is equivalent to the response of the network shown in FIG. 9 provided that the series resonance frequency of the network is equal to a mechanical resonance frequency of crystal as in Eq. (6).

$$W_R = \frac{1}{2\pi\sqrt{LC}} \quad (6)$$

An important difference between equivalent series network of FIG. 9 and the piezoelectric resonator is that the latter has many discrete modes of vibration, whereas the network has only one resonance frequency.

The network elements L, C, and $C_o$ of the equivalent network can be calculated from the physical constants of the crystal. For a typical piezoelectric crystal such as quartz, resonating at about $10^5$ Hz, typical values for the elements of the equivalent network are $L=10^2$ henrys, C=0.02 picofarad and $C_o$=5 picofarad.

The process of the present invention utilizes these principles in the following manner to facilitate the movement of fluid through a piezoelectric medium. The piezoelectric characteristics of the medium are determined from samples including any pattern of recurrent orientation of the crystals other than random within the medium. These samples are subjected to an alternating voltage to force the vibrating crystals to resonance. Approximate values of voltage and frequency are known from mathematical modeling. The values of voltage and frequency are experimentally refined by transducers on the stimulated sample which determine the resonant frequency when the amplitude of vibration is maximal. Sonic and or additional electromagnetic radiation at this frequency is then used to further stimulate the sample. Conventional tests for permeability of the medium are done before and after the experiment and are compared. The tests are repeated altering the orientation of the input energy sources with respect to the medium sample. Results of this series of tests on the representative medium sample yields values for input alternating voltage, resonant frequency and the influence of orientation of the input energy sources on the overall effect. Thus, these parameters are determined experimentally from a representative sample of the medium. Note that the initial resonant vibration can also be achieved by mechanical stimulation using the direct piezoelectric effect.

FIG. 1 illustrates the testing process on a sample 11 from the piezoelectric medium. The sample is stimulated with an alternating voltage causing the piezoelectric crystals to vibrate at frequency w. A vibration transducer 13 senses this frequency and the amplitude of the vibration and feeds back this information to the beginning of the loop. The alternating voltage input of the voltage generator 15 is adjusted in this negative feedback loop until the amplitude of vibration becomes maximal. The frequency is now the resonant frequency w, of the sample. If additional response is needed, the sample is then bombarded with sonic and/or electromagnetic radiation from source 17 which is tuned to match the resonant frequency of the sample. This testing process gives information regarding input voltage characteristics which result in resonant vibration of the piezoelectric crystals in the medium.

The process is then applied to the medium itself using these experimentally derived parameters. Stimulation of the medium is done from any point within, on or outside the medium. If the sample testing demonstrated any recurrent orientation of the piezoelectric crystals in the medium other than random, the stimulating foci are placed to maximize the effect. As with the sample testing operations, vibration transducers are used to feedback amplitudes and frequencies of vibration of the medium. When the frequency of vibration of the medium reaches resonance, the medium is further stimulated by high amplitude sonic or electromechanical energy at the same frequency. Fatigue fractures occur throughout the medium thus increasing the fracture porosity and permeability of the medium in general which facilitates the movement of fluid through it. The friction caused by the vibration increases the temperature of the medium lowering the viscosity of the fluids within it allowing for easier extraction.

Figure 2:
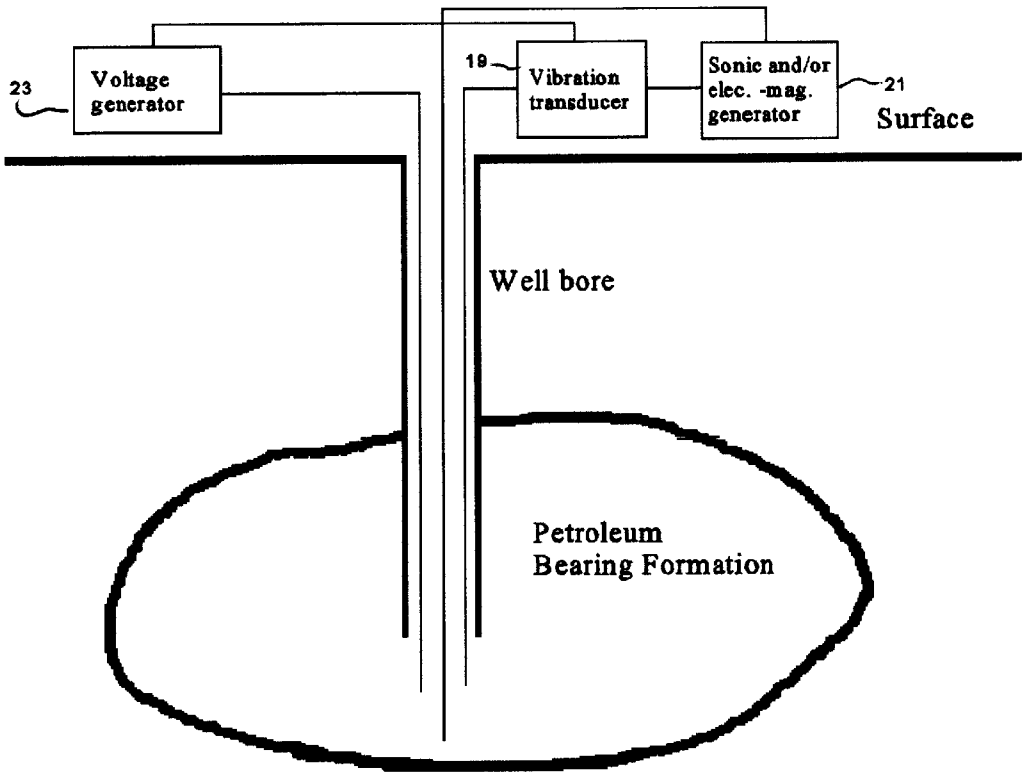
FIG. 2 is a pictorial and block diagram representation of utilization of the converse piezoelectric effect in order to increase the temperature of hydrocarbon bearing formations.

FIG. 2 illustrates the process applied to a piezoelectric medium which is penetrated by a wellbore. The equipment shown consists of a voltage generator 23 which stimulates the piezoelectric crystals within the medium to vibrate. The amplitude and frequency of the vibration are sensed by transducers 19 on or within the medium. This information is fed back to the voltage generator 23. When the amplitude of vibration is maximized, the resonant frequency is defined. At this point, a sonic and/or electromagnetic wave generator source 21 is activated to bombard the medium with energy at this frequency.

Certain physical characteristics of the target medium determine the degree of ease of application and thus the success of this process. Foremost among these is that the medium must possess piezoelectric properties. Quartz, or silicone dioxide, is piezoelectric and contributes significantly to the makeup of the earth's crust. The shear abundance of this material and its intimate relationship with hydrocarbons, either naturally or man made, makes it the most likely medium for application of this process. Also, it is known that electromagnetic radiation penetrates rock less when higher frequencies are implemented. This is also true to a lesser extent with sonic radiation. This limitation thus makes the process more amenable to application near or on the surface as access to the medium for both stimulation and instrumentation is easier. Finally, an ionic environment such as the presence of saline is less desirable as this would tend to short circuit the desired electrical effects.

Figure 3:
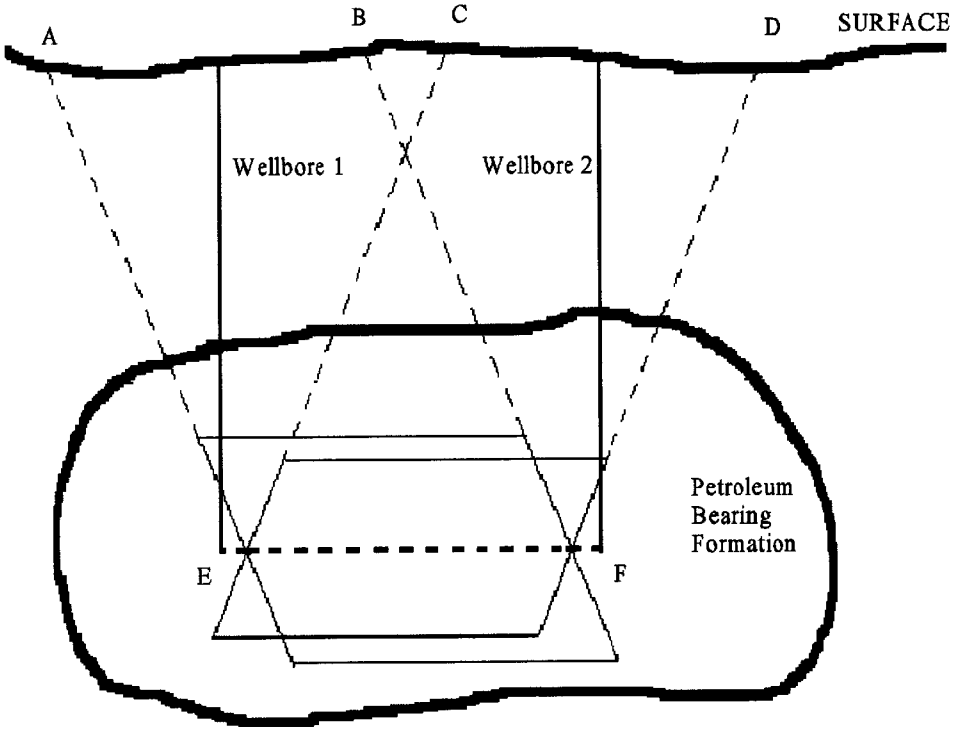
FIG. 3 is a graphical depiction of the capability of the process of the present invention to operate on a preselected volume of formation in order to alter or enhance the recovery of hydrocarbons.

This process has the capability to operate on a preselected volume of the target medium. This is realized by stimulating the preselected volume from multiple foci as shown in FIG. 3. In general, the predetermined volume in the medium to be operated on by this process results from any combination of intersecting geometrical shapes that are generated from the stimulating foci, which are placed strategically to define this specific volume. The overall desired effect is maximized within this volume by stimulating the volume from multiple orientations as the piezoelectric effect is sensitive to relative orientation as noted above. One application of this particular aspect of the process is the ability to weaken a preselected portion of the medium in a controlled fashion by strategic placement of the stimulating foci as shown in FIG. 3. More conventional fracturing techniques, which utterly lack directional control, could then be used and would now have a predetermined path to follow. The resulting fracture enhances fluid movement in the medium.

FIG. 3 demonstrates the capability of the process to operate on a preselected volume of the piezoelectric medium. In this example, points E and F represent different points in two separate well bores that penetrate the medium from the surface. They serve as foci from which an alternating voltage of appropriate frequency emanate, stimulating the volume of the medium between these two points to vibrate at resonant frequency. However, only those piezoelectric crystals aligned properly will be stimulated in this volume. In order to stimulate crystals of different orientations within this volume, the orientation of the input electric field must be different. As illustrated, this could be accomplished from the surface. Points AB and CD represent origins of electric fields from the surface oriented to intersect line EF which is the common line of intersection of all stimulating foci. Thus, the crystals in this volume are maximally stimulated to vibrate at resonant frequency. An infinite number of resulting volumes are possible and are dependent on the location and orientation of the input electric fields and voltages. After resonance is achieved, the vibrating crystals are further stimulated with electromagnetic and/or sonic energy as described above.

Figure 4:
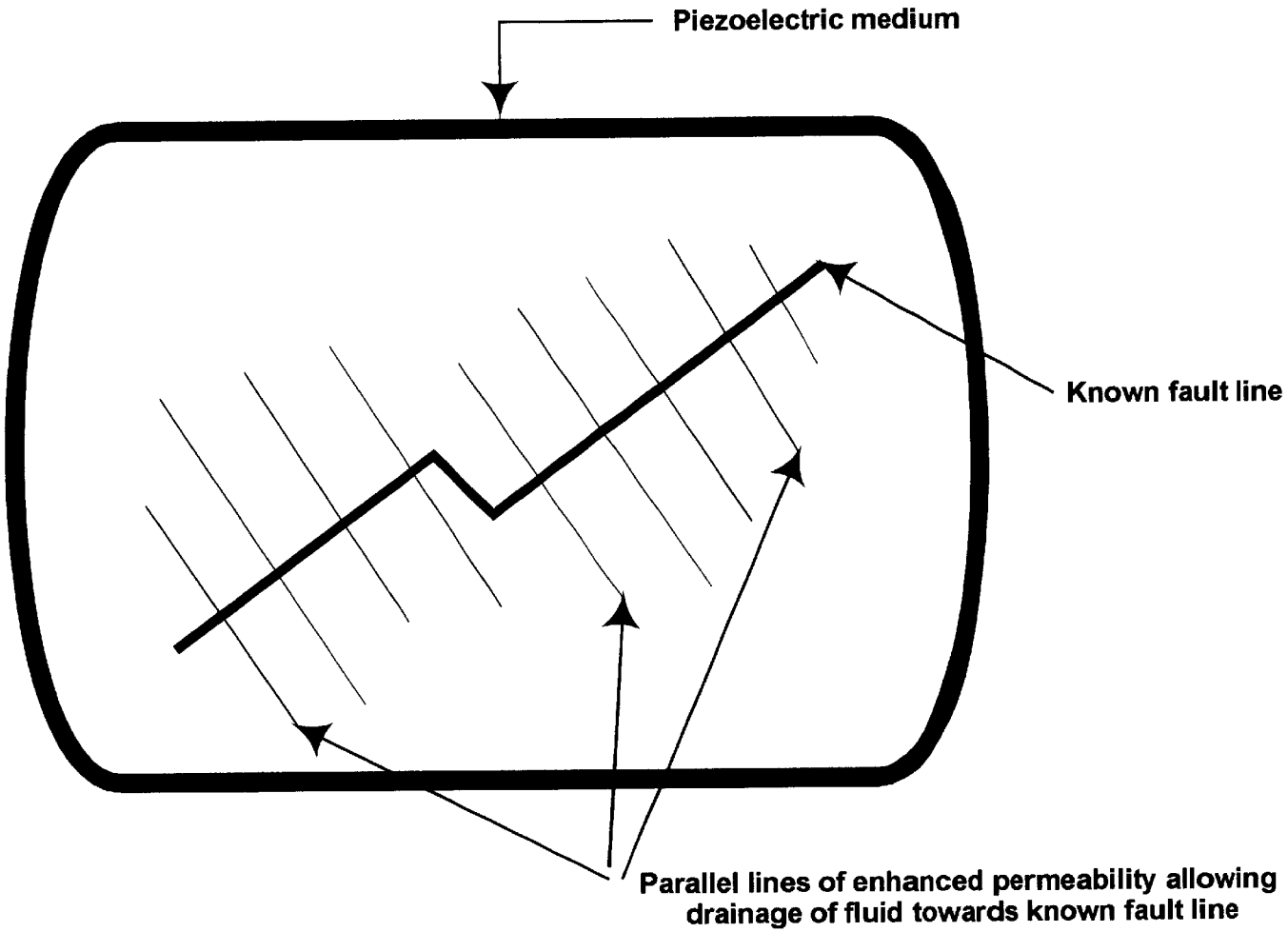
FIGS. 4 and 5 depict particular fault configurations, and are utilized to explain how the present invention exploits the faults.
Figure 5:
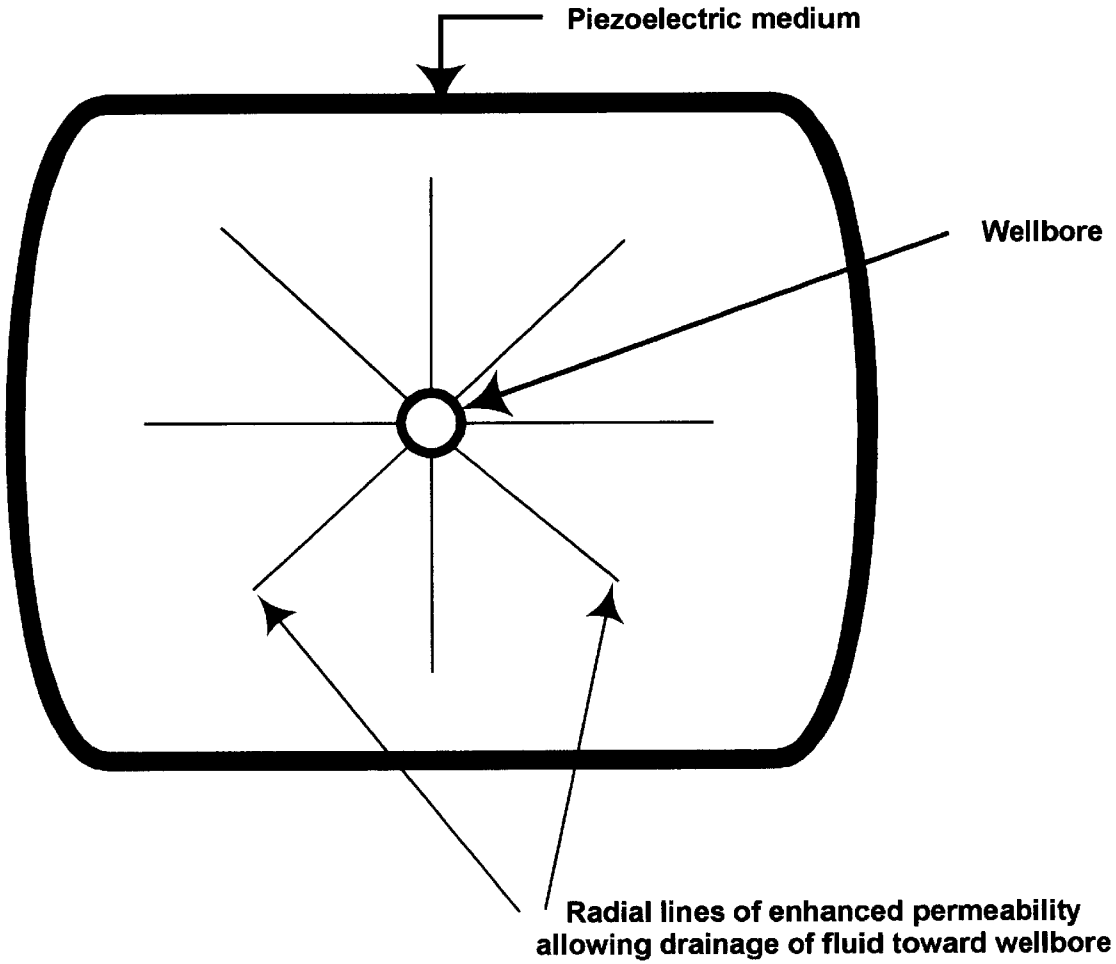

This same process also has the capability to control the orientation of the enhanced permeability by capitalizing on the sensitivity of the piezoelectric effect with regard to the orientation of the crystal with respect to the stimulating field. The net orientation of the micro fractures produced by this process could be manipulated to give the resultant fluid flow in the medium a specific direction. This is accomplished by aligning the stimulating field along the desired orientation of the fractures so that only those crystals within the medium that are aligned properly will be effected. For example, the net orientation and direction of the micro fractures could be manipulated to be parallel to facilitate movement of fluid toward a known fault in the medium as shown in FIG. 4, or radial from a hole in the medium as shown in FIG. 5.

In addition, this process can be used to make the medium itself behave like a peristaltic fluid pump. This is accomplished by stimulating a portion of the piezoelectric medium utilizing the above techniques. By the piezoelectric effect, this portion of the medium deforms causing the net movement of fluid within. Next, an immediately adjacent portion of the medium is identically stimulated while allowing the previous volume to relax. This process is repeated sequentially along a selected direction effectively creating a standing wave of deformation within the medium which pushes fluid ahead of it. The characteristics of the standing wave are adjusted to accommodate the dynamics of the fluid flow in order to maximize it. Again, the necessary parameters are determined experimentally from a medium sample.

Figure 6:
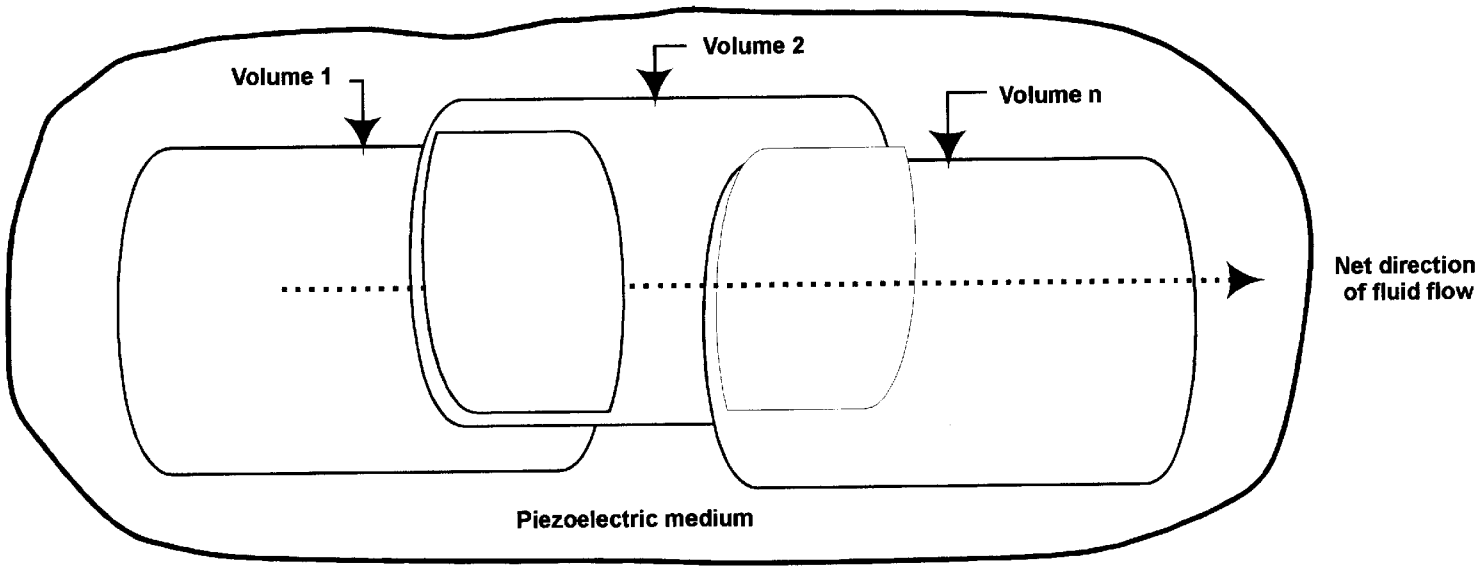
FIGS. 6 and 7 are utilized to explain utilization of the present invention as a peristaltic pump.
Figure 7:
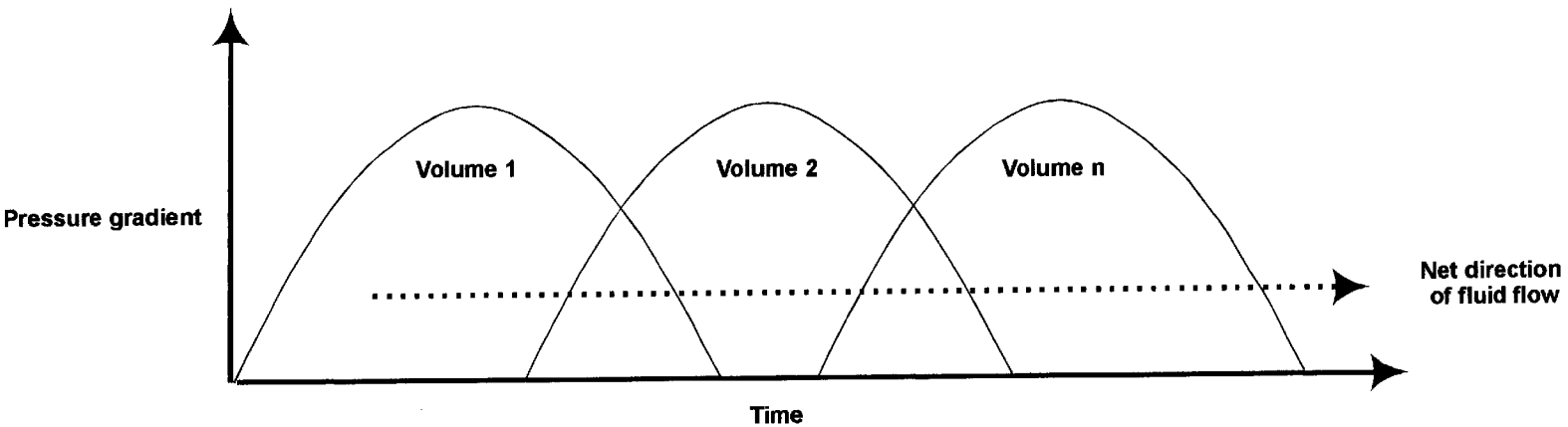

FIG. 6 is an example of the ability of this process to stimulate the piezoelectric medium in such a manner that it causes the medium to behave like a peristaltic pump. In this figure, the piezoelectric medium is divided into n different target volumes such that a line drawn through the center of each volume represents the desired net direction of fluid flow. The necessary values of input electrical energy to achieve the maximum desired effect are determined experimentally using the above techniques. The first volume is then stimulated causing a net deformation of this volume which results in movement of the fluid within it. As this volume is allowed to relax, the immediately adjacent volume is stimulated. This process is continued, sequentially deforming each volume in turn, which pushes fluid in the net direction defined above. FIG. 7 demonstrates this process graphically, showing the changing pressure gradient in each volume over time. The characteristics of the wave of deformation are adjusted to allow maximal flow of fluid.

Additionally, this process can be used to mechanically and electrically agitate the medium and fluid within it. In this case, the medium is stimulated by either sonic or electromagnetic radiation. The resultant piezoelectric effect creates both mechanical and electrical stress within the medium. This energy then weakens the cohesive forces between the medium and fluid facilitating fluid movement within the medium. Initially, the most efficient parameters to achieve this are determined experimentally with a sample of the medium and its resident fluid.

FIG. 8 demonstrates the process applied to an environmental disaster such as an oil spill on a beach. In this case, the piezoelectric medium is sand or silicone dioxide and the target fluid is the spilled oil. Following the steps above, a sample of the contaminated sand is tested to obtain the values of electromagnetic or sonic radiation necessary to achieve either resonance or that which maximizes the desired effect of separating the oil from the sand. The contaminated sand is then placed in a container and mixed with water. The sand is then stimulated with electromagnetic radiation and or sonic radiation. The resultant piezoelectric effect creates both mechanical and electrical stress in the individual sand grains. Specifically, the cohesive forces between the oil and the sand are disrupted by this induced agitation. The separation of the oil from the sand grains during this process is enhanced by the presence of water which is a more polar molecule. The changing electric dipole of the stimulated silicone dioxide crystals both attracts and repulses the polar water molecules increasing the agitation at the sand-oil interface. Final separation of the oil from the sand is realized from gravitational forces acting on the basic difference between the density of water and the density of oil. The gravitational force could be dramatically increased by centrifuging the sand, oil and water. After separation of the oil from the sand is complete, the oil is separated from the water, and the sand is returned to the beach.

Finally, this process has the capability to log the medium in terms of the extent and concentration of fluid within it. When stimulated with electromagnetic energy or mechanical energy, the piezoelectric medium will vibrate yielding both sonic and electromagnetic radiation at a certain frequency. This frequency is dependent on the overall mechanical properties of the medium which is in turn influenced by the type and amount of fluid within it. Given the same electrical or mechanical input, a dry piezoelectric medium will emit a different signal than the same medium containing fluid. The exact relationship between the frequency of the emitted sonic or electromagnetic signal and type and amount of fluid within the medium is again determined experimentally first and then applied to the medium itself. This phenomenon can be further exploited to determine the type of fluid in a piezoelectric medium by determining the sonic or electromagnetic signature that is emitted when the medium is stimulated. This aspect of the process can also be used to monitor the status of the fluid flow within the medium as influenced by the process in general.

In conclusion, this invention facilitates the movement of fluid through any medium that possesses piezoelectric properties. The process increases the permeability of the medium in general or can be used to increase the permeability of a preselected portion of the medium. It has the capability to control the net orientation of the enhanced permeability and to increase the temperature of the medium through frictional effects. It also has the capability to turn the medium into a peristaltic fluid pump and lends itself as a logging tool for piezoelectric media. The process also has the capability to overcome the cohesive forces at the piezoelectric media and fluid interface. These different effects can be used singly, in combination with each other, or in combination with any other commercial technique or natural process to maximize the movement of fluid within the target medium.

Figure 10:
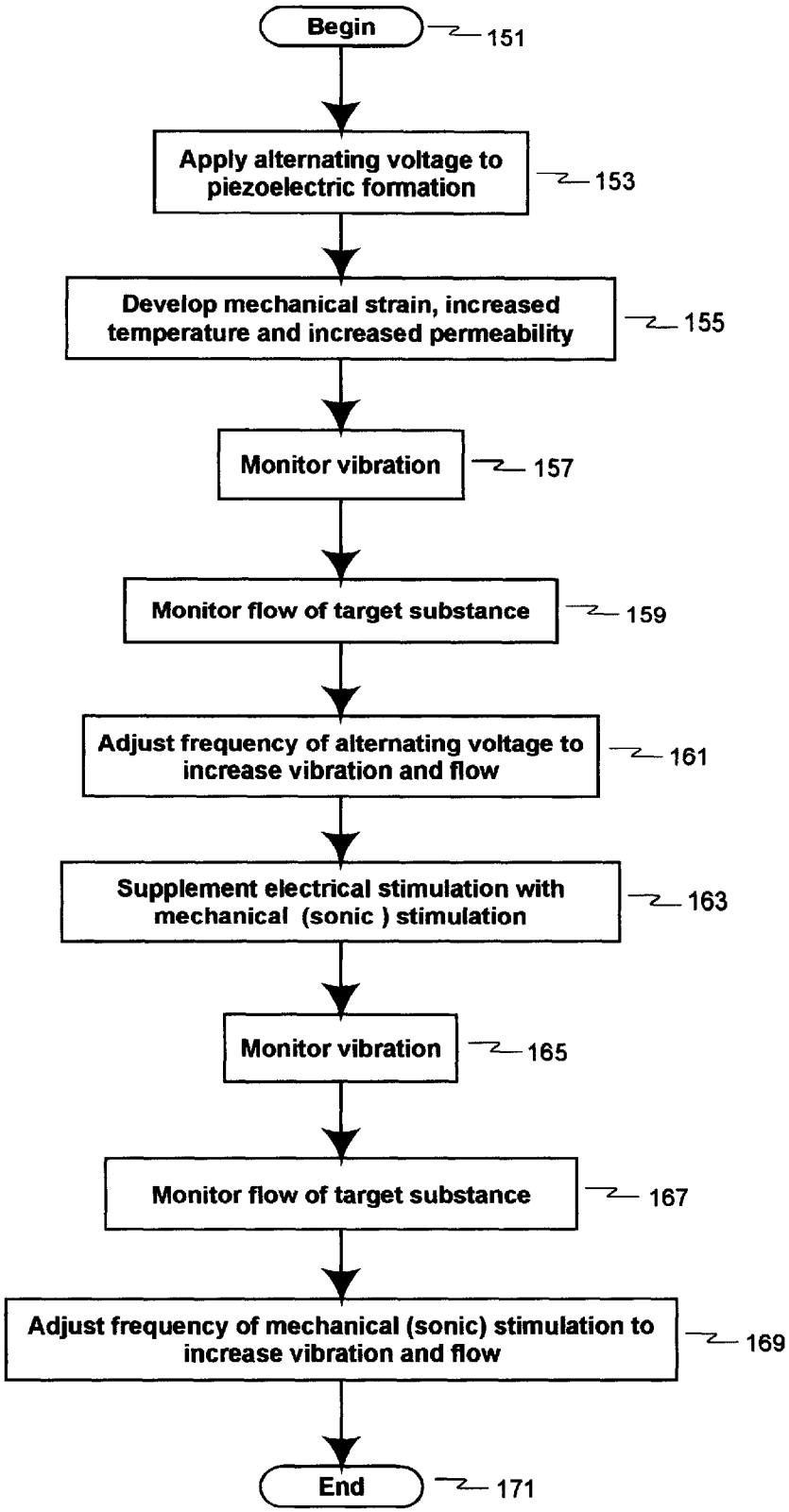
FIG. 10 is a flowchart representation of one preferred application of stimulating energy to an earth formation.

FIG. 10 is a block diagram representation of the application of an alternating energizing source (either or both of the direct piezoelectric effect and converse piezoelectric effect) in broad overview form. The process begins at block 151, and continues at block 153, wherein alternating voltages applied to the piezoelectric formation. In accordance with block 155, mechanical strain is developed in the formation which increases temperature and increases permeability of the target substance within the formation. In accordance with block 157, monitoring devices are utilized to monitor the vibration of the formation. In accordance with block 159, the flow is also monitored of the target substance from the formation. In accordance with the present invention, fluids may be lifted from the earth formation utilizing conventional technologies such as artificial or gas lift technologies to lift fluid and hydrocarbons to the surface for further processing. Alternatively, and supplementally, conventional water flooding technologies may be utilized to direct the flow of hydrocarbon bearing fluids within a hydrocarbon bearing zone. In accordance with block 161, the frequency of the alternating voltage is adjusted in order to increase the vibration induced within the wellbore and to increase flow of the target substance. Preferably, but not necessarily, the frequency of maximum excitation and maximum flow of the target substance is likely to be the resonant frequency of the piezoelectric material in the formation. In accordance with block 163, the electrical stimulation of the formation is supplemented by mechanical and/or sonic stimulation of the formation utilizing an alternating vibration or sonic source. In accordance with blocks 165 and 167, sensors are utilized to monitor the amount of vibration within a formation and the amount of flow the target substance from the earth formation. In accordance with block 169, the frequency of the mechanical and/or sonic stimulation of the formation is adjusted to increase and optimize vibration which is induced in the formation and flow of the target substance of the formation. Once again, the frequency of optimum operation is likely to be the resonant frequency of the piezoelectric material. The processing ends at block 171.

Figure 11:
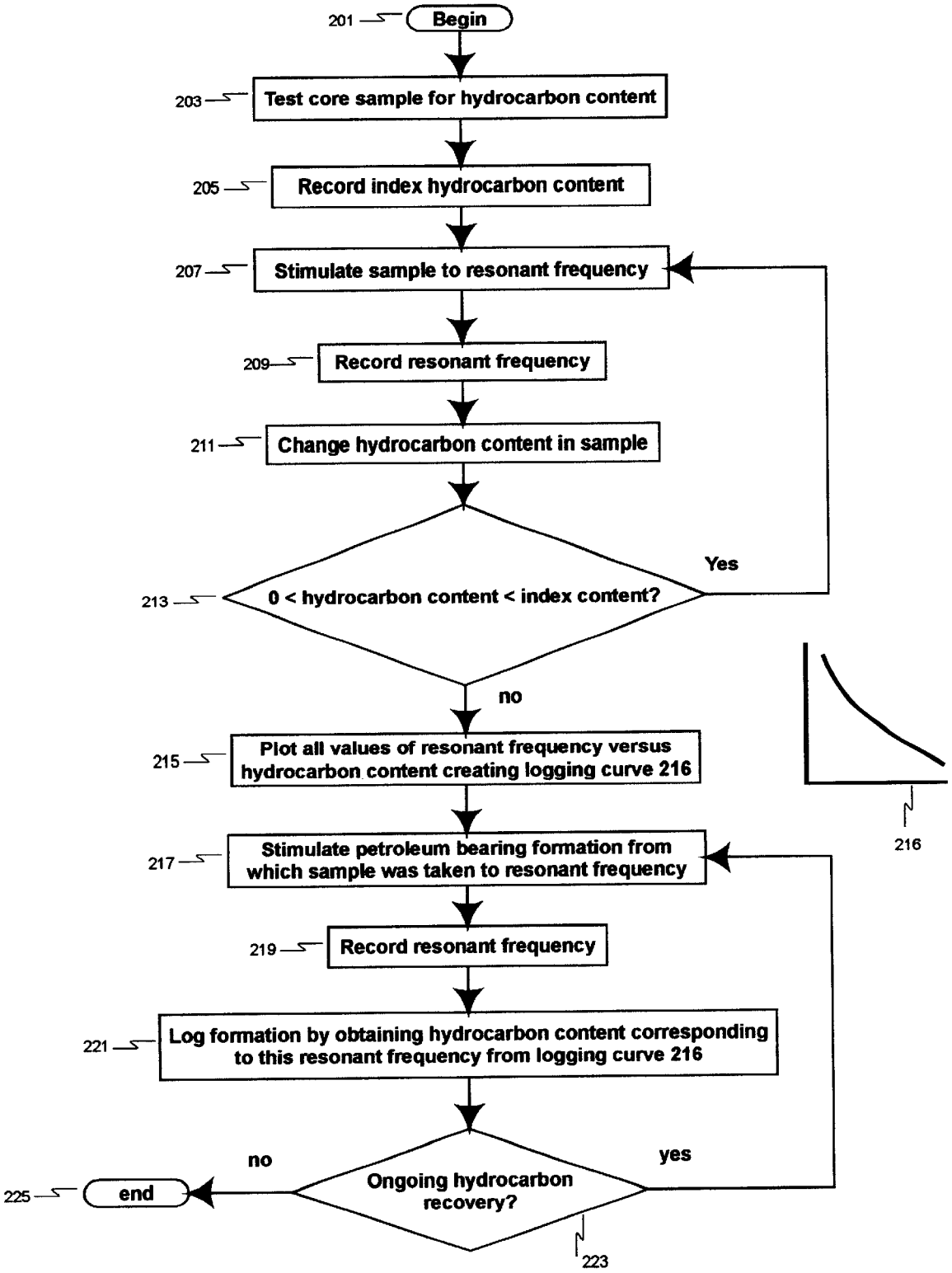
FIG. 11 is a flowchart representation of the implementation of the present invention in order to log particular formations.

FIG. 11 is a high level flowchart representation of the utilization of the method and apparatus of the present invention for logging the content of a particular formation. The process begins at block 201, and continues at block 203, wherein core samples are tested to determine the hydrocarbon content. Next, in accordance with block 205, the hydrocarbon content is recorded. Then, in accordance with block 207, the core sample is stimulated to determine its resonant frequency. In accordance with block 209, the resonant frequency is recorded in memory. Then, in accordance with block 211, the hydrocarbon content of the sample is changed. According to block 213, the hydrocarbon content of the sample is examined to determine whether it falls within the range of zero through a particular index content. If so, control returns to block 207; if not, control passes to block 215, wherein a plot is generated of all the values of resonant frequency versus hydrocarbon content in order to create a logging curve, such as logging curve 216.

The process continues at block 217, wherein the petroleum bearing formation, from which the sample has been taken and studied, is istimulated in order to obtain the resonant frequency. In accordance with block 219, the resonant frequency is recorded. Then, in accordance with block 221, the formation is logged by obtaining hydrocarbon content which corresponds to the resonant frequency from the logging curve created above. In accordance with block 223, analysis is performed to determine whether there is on-going hydrocarbon recovery; if so, control passes to block 217, for further stimulation; however, if not, control passes to block 225, wherein the process ends.

Figure 12:
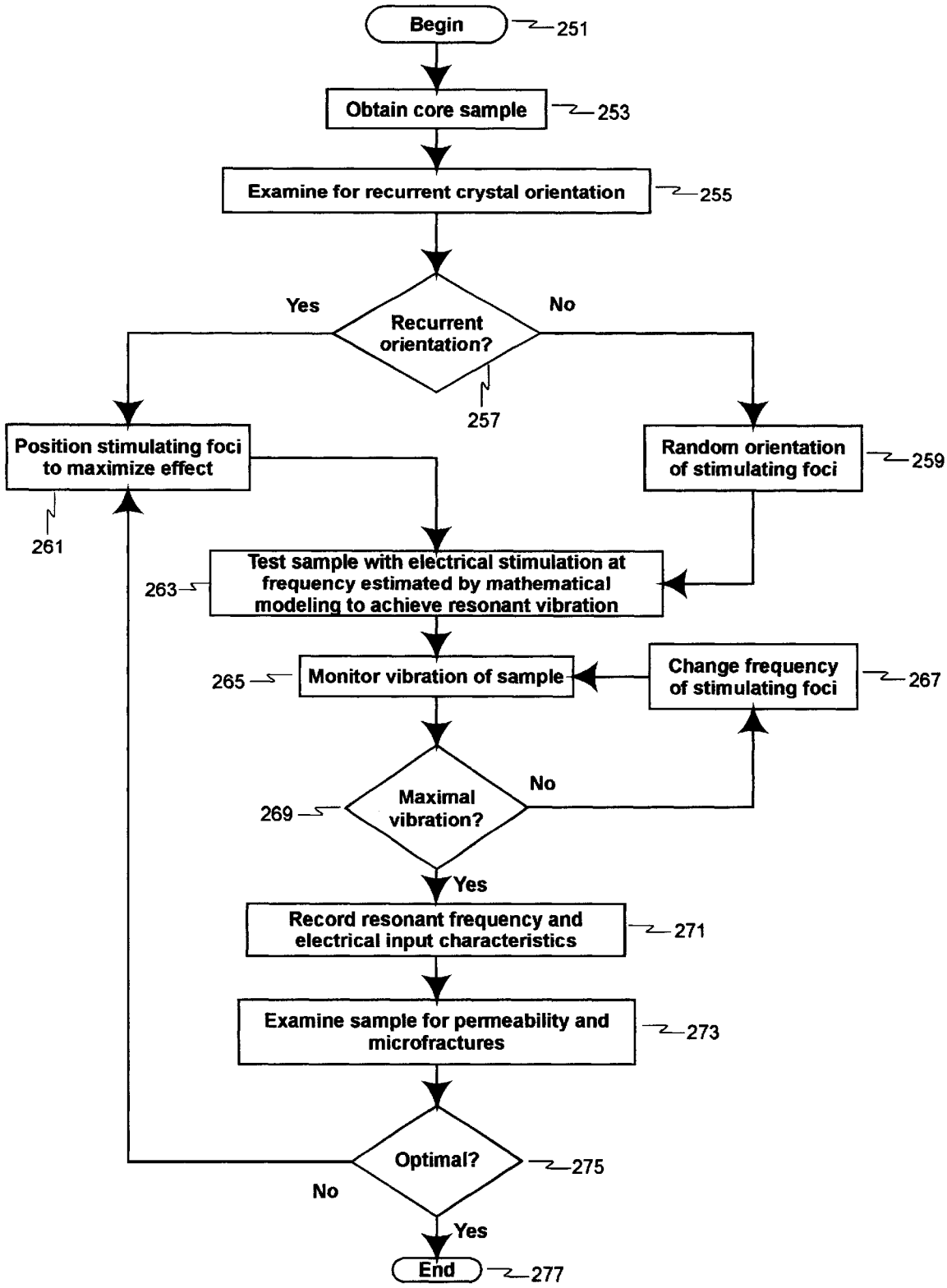
FIG. 12 is a flowchart representation of the testing process utilized in accordance with the preferred embodiment of the present invention.

FIG. 12 is a block diagram depictions of testing in accordance with the present invention of samples as part of the implementation of the method and apparatus for piezoelectric transport of target substances. The process begins at block 251, and continues at block 253, wherein a core sample of a formation of interest is obtained. Next, in accordance with block 255, the core sample is examined to determine the extent of recurrent crystal orientation. In accordance with block 257, if recurrent orientation is present, control passes to block 259; however, if recurrent orientation is not present, control passes to block 261.

In accordance with block 259, the stimulating energy to be employed with that particular formation is randomly oriented. This is in contrast with block 251, wherein the stimulating energy is positioned to maximize the effect in view of the existence of recurrent orientation in the target formation. In accordance with block 263, the sample is tested with electrical stimulation at a frequency estimated by mathematical modeling. In accordance with block 265, the vibration of the sample is monitored. In accordance with block 267, the frequency of stimulation is changed. In accordance with block 269, the vibration is monitored to determine maximum vibration. This process is utilized to determine the particular stimulating frequency which produces a maximum vibration in a sample. Once a maximum vibration is detected, control passes to block 271, wherein the resonant frequency is recorded and the electrical input characteristics of the stimulator frequency also recorded. Next, in accordance with block 273, the sample is examined to determine permeability and microfractures. If permeability and microfractures have been optimized, as determined at block 275, the process passes control to block 277, wherein it ends; however, if it is determined that block 275 that optimum permeability and microfractures have not been obtained, control passes back to block 261, wherein the position of the stimulating energy is determined. In practice, the position of the stimulating energy will be altered in view of the existing data set, and the testing of blocks 263 through 275 will continue until the maximum effect of the stimulating energy position is determined.

Figure 13:
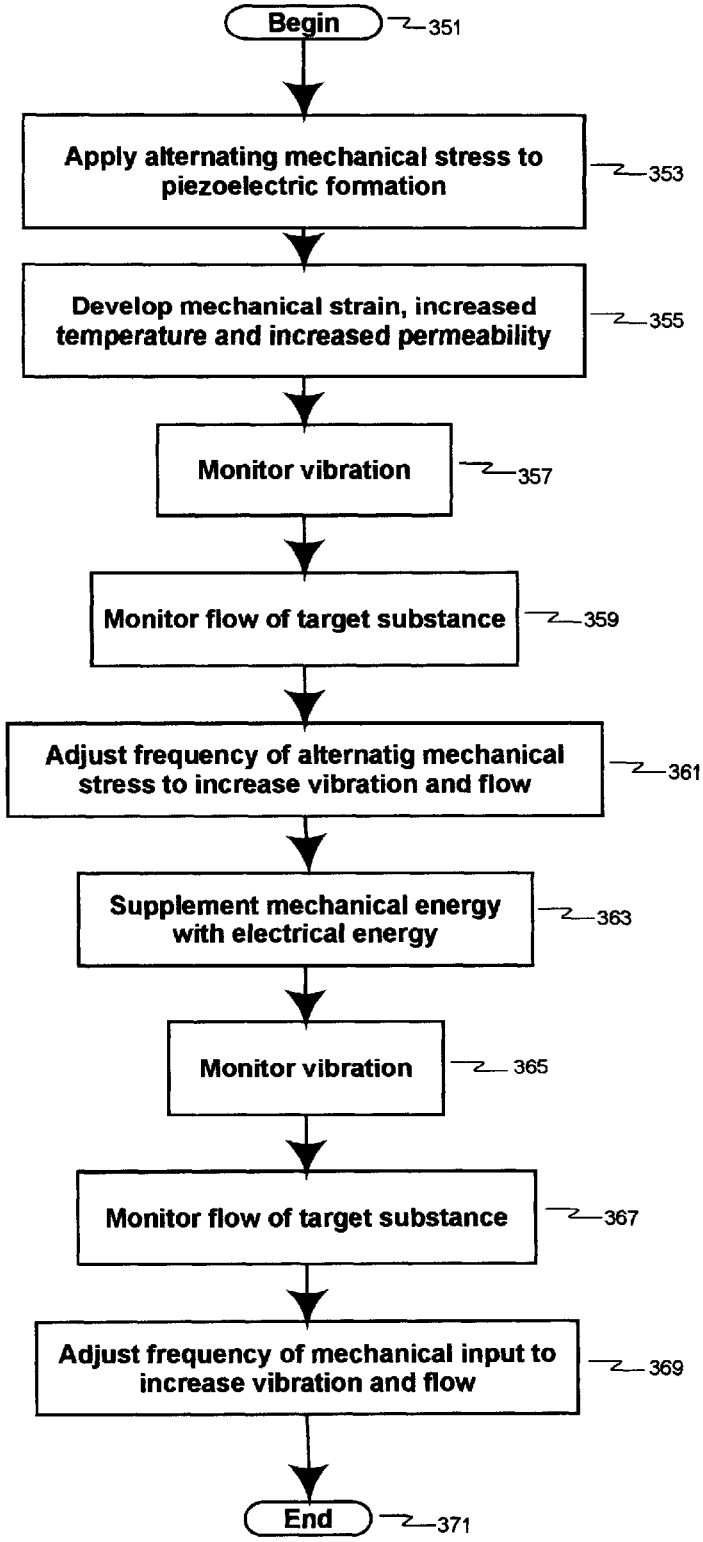
FIG. 13 is a flowchart representation of a primarily mechanical embodiment of the piezoelectric transport method of the present invention.

FIG. 13 is a block diagram representation of the application of an alternating mechanical energizing source in broad overview form. The process begins at block 351, and continues at block 353, wherein alternating mechanical stress is applied to the piezoelectric formation. In accordance with block 355, mechanical strain is developed in the formation which increases temperature and increases permeability of the target substance within the formation. In accordance with block 357, monitoring devices are utilized to monitor the vibration of the formation. In accordance with block 359, the flow is also monitored of the target substance from the formation. In accordance with the present invention, fluids may be lifted from the earth formation utilizing conventional technologies such as artificial or gas lift technologies to lift fluid and hydrocarbons to the surface for further processing. Alternatively, and supplementally, conventional water flooding technologies may be utilized to direct the flow of hydrocarbon bearing fluids within a hydrocarbon bearing zone. In accordance with block 361, the frequency of the alternating mechanical stress is adjusted in order to increase the vibration induced within the welibore and to increase flow of the target substance. Preferably, but not necessarily, the frequency of maximum excitation and maximum flow of the target substance is likely to be the resonant frequency of the piezoelectric material in the formation. In accordance with block 363, the mechanical stimulation of the formation is supplemented by electrical stimulation of the formation utilizing an alternating voltage source. In accordance with blocks 365 and 367, sensors are utilized to monitor the amount of vibration within a formation and the amount of flow the target substance from the earth formation. In accordance with block 369, the frequency of the mechanical and/or sonic stimulation of the formation is adjusted to increase and optimize vibration which is induced in the formation and flow of the target substance of the formation. Once again, the frequency of optimum operation is likely to be the resonant frequency of the piezoelectric material. The processing ends at block 371.

Figure 14:
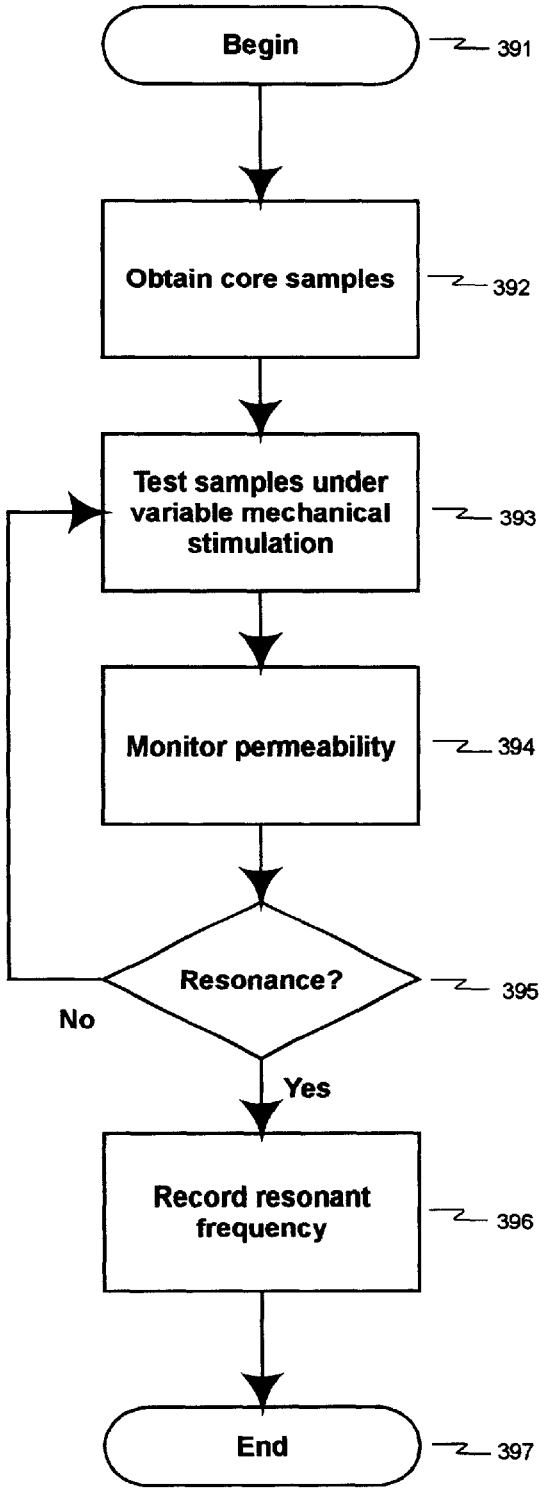
FIG. 14 is a flowchart representation of the process of testing samples to determine mechanical resonance.

FIG. 14 is a flowchart representation in broad overview of the preferred process of determining resonance of particular samples. The process begins at block 391 and continues to block 392, wherein core samples of the earth's formation of interest are obtained. Then, in accordance block 393, the samples are tested under variable mechanical stimulation. In accordance with block 394, the permeability of the samples is monitored. Additionally, in accordance with block 395, the sample is monitored with sensors to determine whether the sample is in resonance. If not, control returns to block 393, wherein the frequency and/or amplitude of the mechanical stimulation is altered in a predetermined manner; however, if it is determined in block 395 that resonance is occurring, in accordance with block 396, the resonant frequency is recorded, and the process ends at block 397.

Figure 15:
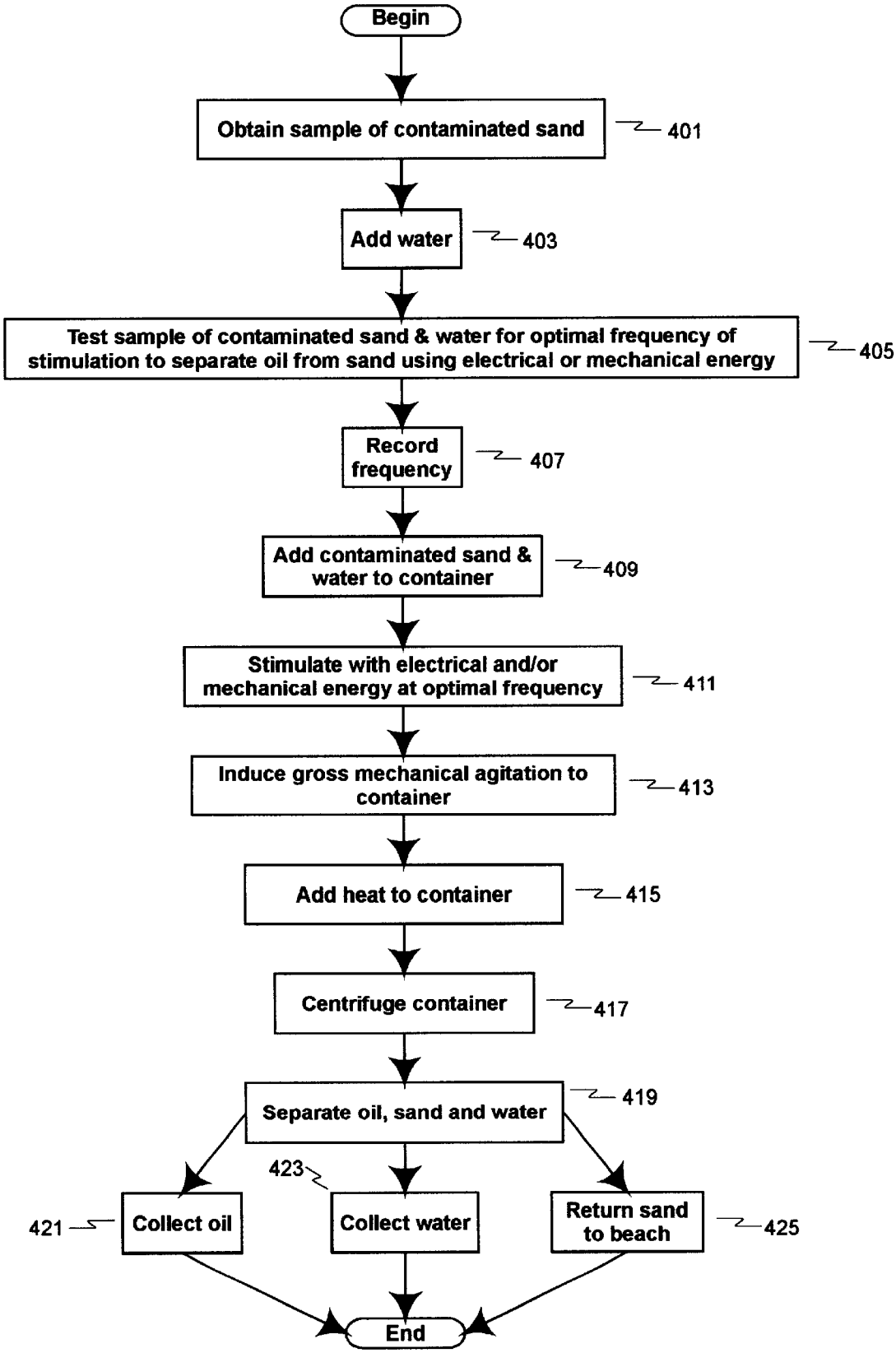
FIG. 15 is a flowchart representation of the utilization of the present invention for environmental clean-up operations.

FIG. 15 is a flowchart representation of the utilization of the present invention to remove contaminates from soil. This has particular applicability of the clean-up of oil spills on sandy soils, such as beaches. The process commences at block 401, wherein samples of the contaminated soil or sand are obtained. Then, in accordance with block 403, water is added to the sample. Next, in accordance with block 405, the sample is tested for optimum frequency of stimulation in order to separate the oil from the sand utilizing electrical and/or mechanical energy. In accordance with block 407, the resonant frequencies are recorded. In accordance with block 409, contaminated sand and water are added together in a container. Then, in accordance with block 411, electrical and/or mechanical stimulating energy is applied to the container at the optimum excitation frequency. Next, in accordance with block 413, the container is mechanically agitated in a gross manner. This may be obtained by utilizing any number of conventional shaking or mixing devices. Next, in accordance with block 415, heat is added to the container. Then, in accordance with block 417, the container is subjected to a centrifuge motion which helps to separate, in accordance with block 419, the oil, sand, and water. In accordance with blocks 421, 423, 425, the oil and water are collected, and the sand is returned to the beach area.

What is claimed is:

1. A method of enhancing the transport of a target substance in a particular earth formation, comprising the method steps of:

(a) identifying a particular earth formation having a piezoelectric property and which bears said target substance;

(b) applying a voltage to at least a particular portion of said particular earth formation, in order to develop mechanical stress in said particular portion of said particular earth formation, utilizing said piezoelectric property of said particular earth formation, in order to facilitate removal of said target substance; and (c) utilizing at least one removal process in combination with said step of applying said voltage to transport at least a portion of said target substance away from said at least one particular portion of said particular earth formation.

2. A method according to claim 1, wherein said target substance comprises a hydrocarbon substance.

3. A method according to claim 1, wherein said particular earth formation comprises a subterranean earth formation.

4. A method according to claim 1, wherein said at least one removal process comprises at least one of the following:

(a) artificial lift of fluids from a wellbore;

(b) waterflood of at least said particular earth formation.

5. A method according to claim 1, wherein said voltage comprises an alternating voltage.

6. A method according to claim 1, wherein said mechanical stress alters a permeability of said at least one particular portion of said particular earth formation.

7. A method according to claim 1, wherein said mechanical stress develops a localized temperature increase in said at least one particular portion of said particular earth formation which alters a permeability of said at least one particular portion of said particular earth formation.

8. A method according to claim 1, wherein said step of applying a voltage comprises:

applying a plurality of voltages to a plurality of particular portions of said particular earth formation in order to develop a plurality of differing mechanical stresses in said particular earth formation which develop an enhanced permeability having a controllable directional orientation, utilizing said piezoelectric property, in order to facilitate removal of said target substance.

9. A method according to claim 1, wherein said step of applying a voltage comprises:

applying a plurality of voltages in a predetermined pattern with respect to time to a plurality of particular portions of said particular earth formation in order to utilize said piezoelectric property to apply variable mechanical stresses thereto in order to sequentially deform said plurality of particular portions of said particular earth formation and to evacuate fluid therefrom with a resulting peristaltic fluid pump action.

10. A method according to claim 1, wherein said step of applying a voltage comprises:

applying an alternating voltage to said at least one particular portion of said particular earth formation in order to utilize said piezoelectric property to apply mechanical stresses to said at least one portion of said particular earth formation to mechanically and electrically agitate said at least one particular portion of said particular earth formation to overcome cohesive forces between said particular earth formation and said target substance.

11. A method according to claim 1, further comprising:

(d) applying mechanical stress to said at least one portion of said particular earth formation in order to generate electrical voltages in accordance with said piezoelectric effect utilizing said piezoelectric property of said particular formation.

12. A method according to claim 1, further comprising:

(d) identifying a resonant piezoelectric frequency associated with said particular earth formation; and (e) in said step of applying a voltage, applying an alternating voltage having a frequency which generally corresponds to said resonant piezoelectric frequency of said particular earth formation.

13. A method according to claim 12, wherein said resonant piezoelectric frequency is determined experimentally from an examination of said particular earth formation.

14. A method according to claim 12, wherein said resonant piezoelectric frequency is determined by optimization of extraction of said target substance from said particular earth formation.

15. A method enhancing the transport of a target substance in a at least one earth formation, comprising the method steps of:

(a) examining said at least one earth formation in order to determine the presence and magnitude of a piezoelectric property of material contained therein;

(b) experimentally determining an optimum frequency for piezoelectric stimulation of said at least on earth formation;

(c) selectively applying an alternating voltage to said at least one earth formation which has a frequency generally corresponding to said optimum frequency;

(d) altering at least one of the following with application of said alternating voltage:

(1) temperature of said at least one earth formation;

(2) permeability of said at least one earth formation to the transport of said target substance;

(3) cohesion between said at least one earth formation and said target substance;

(e) lifting fluids which contain said target substance which have been liberated from said at least one earth formation at least in part in response to said step of selectively applying.

16. A method according to claim 15, wherein said optimum frequency defines a harmonic frequency of excitation associated with said at least one earth formation.

17. A method according to claim 15, wherein said target substance comprises a hydrocarbon substance.

18. A method according to claim 15, wherein said particular earth formation comprises a subterranean earth formation.

19. A method according to claim 15, wherein said voltage comprises an alternating voltage.

20. A method according to claim 15, wherein said mechanical stress which alters a permeability of said at least one earth formation.

21. A method according to claim 15, wherein said alternating voltage develops mechanical stress which generates a localized temperature increase in said at least one earth formation.

22. A method according to claim 15, wherein said step of applying a voltage comprises:

applying a plurality of voltages to a plurality of particular portions of said at least one earth formation in order to develop a plurality of differing mechanical stresses in said at least one earth formation which develop an enhanced permeability having a controllable directional orientation, utilizing said piezoelectric property, in order to facilitate removal of said target substance.

23. A method according to claim 15, wherein said step of applying a voltage comprises:

applying a plurality of voltages in a predetermined pattern with respect to time to a plurality of particular portions of said at least one earth formation in order to utilize said piezoelectric property to apply variable mechanical stresses thereto in order to sequentially deform said plurality of particular portions of said at least one earth formation and to evacuate fluid therefrom with a resulting peristaltic fluid pump action.

24. A method according to claim 15, wherein said step of applying a voltage comprises:

applying an alternating voltage to said at least one particular portion of said at least one earth formation in order to utilize said piezoelectric property to apply mechanical stresses to said at least one portion of said at least one earth formation to mechanically and electrically agitate said at least one particular portion of said at least one earth formation to overcome cohesive forces between said at least one earth formation and said target substance.

25. A method according to claim 15, further comprising:

(d) applying mechanical stress to said at least one portion of said at least one earth formation in order to generate electrical voltages in accordance with said piezoelectric effect utilizing said piezoelectric property of said at least one formation.

26. A method according to claim 25, wherein said resonant piezoelectric frequency is determined experimentally from an examination of said at least one earth formation.

27. A method according to claim 25, wherein said resonant piezoelectric frequency is determined by optimization of extraction of said target substance from said at least one earth formation.

28. A method of enhancing hydrocarbon production from an oil and/or gas wellbore which extends into at least one hydrocarbon bearing formation, comprising the method steps of:

(a) obtaining characterizing information pertaining to said at least one hydrocarbon bearing formation;

(b) utilizing said characterizing information in order to determine at least one operating attribute of a converse piezoelectric effect energizing source;

(c) providing a converse piezoelectric effect energy source;

(d) coupling said converse piezoelectric effect energy source to said at least one hydrocarbon bearing formation;

(e) operating said converse piezoelectric effect energy source in accordance with said at least one operating attribute in order to stimulate a piezoelectric response in said at least one hydrocarbon bearing formation causing the production of hydrocarbons; and (f) producing hydrocarbons from said wellbore.

29. A method according to claim 28, further comprising:

(g) alternating said at least one operating attribute of said converse piezoelectric effect energy source with respect to time to enhance the production of hydrocarbon from said wellbore.

30. A method according to claim 28, further comprising:

(g) applying said converse piezoelectric effect energy source in a different manner to particular portions of said at least one hydrocarbon bearing formation in order to develop permeability gradients to direct the flow of hydrocarbons.

31. A method according to claim 28, wherein said at least one operation attribute comprises an optimum frequency which defines a piezoelectric frequency of excitation.

32. A method according to claim 28, wherein said target substance comprises a hydrocarbon substance.

33. A method according to claim 28, wherein said particular earth formation comprises a subterranean earth formation.

34. A method according to claim 28, wherein said alternating energy source comprises an alternating voltage.

35. A method according to claim 28, wherein said mechanical stress which alters a permeability of said at least one earth formation.

36. A method according to claim 28, wherein said alternating voltage develops mechanical stress which generates a localized temperature increase in said at least one earth formation.

37. A method according to claim 28, further comprising:

(g) identifying a resonant piezoelectric frequency associated with said at least one earth formation; and (h) in said step of applying an alternating energy source, applying an alternating vibration having a frequency which generally corresponds to said resonant piezoelectric frequency of said at least one earth formation.

38. A method according to claim 37, wherein said resonant piezoelectric frequency is determined experimentally from an examination of said at least one earth formation.

39. A method according to claim 37, wherein said resonant piezoelectric frequency is determined by optimization of extraction of said hydrocarbons from said at least one earth formation.

40. A method of enhancing the transport of a target substance in a particular earth formation, comprising the method steps of:

(a) identifying a particular earth formation having a piezoelectric property and which bears said target substance;

(b) applying mechanical stress to at least a particular portion of said particular earth formation, in order to develop electrical voltages in said particular portion of said particular earth formation through the piezoelectric stimulation of said particular earth formation, in order to facilitate removal of said target substance; and (c) utilizing at least one removal process in combination with said step of applying mechanical stress to transport at least a portion of said target substance away from said at least one particular portion of said particular earth formation.

41. A method according to claim 40, wherein said target substance comprises a hydrocarbon substance.

42. A method according to claim 40, wherein said particular earth formation comprises a subterranean earth formation.

43. A method according to claim 40, wherein said at least one removal process comprises at least one of the following:

(a) artificial lift of fluids from a wellbore;

(b) waterflood of at least said particular earth formation.

44. A method according to claim 40, wherein said mechanical stress alters a permeability of said at least one particular portion of said particular earth formation.

45. A method according to claim 40, wherein said mechanical stress develops a localized temperature increase in said at least one particular portion of said particular earth formation which alters a permeability of said at least one particular portion of said particular earth formation.

46. A method according to claim 41, further comprising:

(d) applying a voltage to at least a particular portion of said particular earth formation, in order to develop mechanical stress in said particular portion of said particular earth formation, utilizing said piezoelectric property, in order to facilitate removal of said target substance.

47. A method according to claim 46, wherein said step of applying a voltage comprises:

applying a plurality of voltages to a plurality of particular portions of said particular earth formation in order to develop a plurality of differing mechanical stresses in said particular earth formation which develop an enhanced permeability having a controllable directional orientation, utilizing said piezoelectric property, in order to facilitate removal of said target substance.

48. A method according to claim 46, wherein said step of applying a voltage comprises:

applying a plurality of voltages in a predetermined pattern with respect to time to a plurality of particular portions of said particular earth formation in order to utilize said piezoelectric property to apply variable mechanical stresses thereto in order to sequentially deform said plurality of particular portions of said particular earth formation and to evacuate fluid therefrom with a resulting peristaltic fluid pump action.

49. A method according to claim 46, wherein said step of applying a voltage comprises:

applying an alternating voltage to said at least one particular portion of said particular earth formation in order to utilize said piezoelectric property to apply mechanical stresses to said at least one portion of said particular earth formation to mechanically and electrically agitate said at least one particular portion of said particular earth formation to overcome cohesive forces between said particular earth formation and said target substance.

50. A method according to claim 40, further comprising:

(d) identifying a resonant piezoelectric frequency associated with said particular earth formation; and (e) in said step of applying a mechanical stress, applying an alternating mechanical stress having a frequency which generally corresponds to said resonant piezoelectric frequency of said particular earth formation.

51. A method according to claim 50, wherein said resonant piezoelectric frequency is determined experimentally from an examination of said particular earth formation.

52. A method according to claim 50, wherein said resonant piezoelectric frequency is determined by optimization of extraction of said target substance from said particular earth formation.

53. A method enhancing the transport of a target substance in an earth formation, comprising the method steps of:

(a) examining at least one earth formation surrounding said wellbore in order to determine the presence and magnitude of a piezoelectric property of material contained therein;

(b) experimentally determining an optimum frequency for piezoelectric stimulation of said at least on earth formation;

(c) selectively applying mechanical stress to said at least one earth formation which has a frequency generally corresponding to said optimum frequency;

(d) altering at least one of the following with application of said mechanical stress:

(1) temperature of said at least one earth formation;

(2) permeability of said at least one earth formation to the transport of said target substance;

(3) cohesion between said at least one earth formation and said target substance;

(e) lifting fluids which contain said target substance which have been liberated from said at least one earth formation at least in part in response to said step of selectively applying.

54. A method according to claim 53, wherein said optimum frequency defines a harmonic frequency of excitation associated with said at least one earth formation.

55. A method according to claim 53, wherein said target substance comprises a hydrocarbon substance.

56. A method according to claim 53, wherein said particular earth formation comprises a subterranean earth formation.

57. A method according to claim 53, wherein said mechanical stress comprises an alternating mechanical stress.

58. A method according to claim 53, wherein said mechanical stress which alters a permeability of said at least one earth formation.

59. A method according to claim 53, wherein said alternating mechanical stress which generates a localized temperature increase in said at least one earth formation.

60. A method according to claim 53, wherein said step of applying a mechanical stress comprises:

applying a plurality of mechanical stresses to a plurality of particular portions of said at least one earth formation in order to develop a plurality of differing alternating voltages in said at least one earth formation which develop an enhanced permeability having a controllable directional orientation, utilizing said piezoelectric property, in order to facilitate removal of said target substance.

61. A method according to claim 53, wherein said step of applying a mechanical stress comprises:

applying a plurality of mechanical stresses in a predetermined pattern with respect to time to a plurality of particular portions of said at least one earth formation in order to utilize said piezoelectric property to apply variable alternating voltages thereto in order to sequentially deform said plurality of particular portions of said at least one earth formation and to evacuate fluid therefrom with a resulting peristaltic fluid pump action.

62. A method according to claim 53, wherein said step of applying a mechanical stress comprises:

applying an alternating mechanical stress to said at least one particular portion of said at least one earth formation in order to mechanically and electrically agitate said at least one particular portion of said at least one earth formation to overcome cohesive forces between said at least one earth formation and said target substance.

63. A method according to claim 53, further comprising:

(f) applying at least one alternating electrical voltage to said at least one portion of said at least one earth formation in order to generate a piezoelectric effect utilizing said piezoelectric property of said at least one formation.

64. A method according to claim 53, further comprising:

(f) identifying a resonant piezoelectric frequency associated with said at least one earth formation; and (g) in said step of applying a mechanical stress, applying an alternating mechanical stress having a frequency which generally corresponds to said resonant piezoelectric frequency of said at least one earth formation.

65. A method according to claim 64, wherein said resonant piezoelectric frequency is determined experimentally from an examination of said at least one earth formation.

66. A method according to claim 64, wherein said resonant piezoelectric frequency is determined by optimization of extraction of said target substance from said at least one earth formation.

67. A method of enhancing the transport of a target substance in a particular earth formation, comprising the method steps of:

(a) identifying a particular earth formation having a piezoelectric property and which bears said target substance;

(b) identifying a resonant piezoelectric frequency associated with said particular earth formation; and (c) applying a voltage to at least a particular portion of said particular earth formation, in order to develop mechanical stress in said particular portion of said particular earth formation, utilizing said piezoelectric property of said particular earth formation, in order to facilitate removal of said target substance; and (d) in said step of applying a voltage, applying an alternating voltage having a frequency which generally corresponds to said resonant piezoelectric frequency of said particular earth formation;

(e) utilizing at least one removal process in combination with said step of applying said voltage to transport at least a portion of said target substance away from said at least one particular portion of said particular earth formation.

68. A method according to claim 67, wherein said target substance comprises a hydrocarbon substance.

69. A method according to claim 67, wherein said particular earth formation comprises a subterranean earth formation.

70. A method according to claim 67, wherein said at least one removal process comprises at least one of the following:

(a) artificial lift of fluids from a wellbore;

(b) waterflood of at least said particular earth formation.

71. A method according to claim 67, wherein said voltage comprises an alternating voltage.

72. A method according to claim 67, wherein said mechanical stress alters a permeability of said at least one particular portion of said particular earth formation.

73. A method according to claim 67, wherein said mechanical stress develops a localized temperature increase in said at least one particular portion of said particular earth formation which alters a permeability of said at least one particular portion of said particular earth formation.

74. A method according to claim 67, wherein said step of applying a voltage comprises:

applying a plurality of voltages to a plurality portions of said particular earth formation in order to develop a plurality of differing mechanical stresses in said particular earth formation which develop an enhanced permeability having a controllable directional orientation, utilizing said piezoelectric property, in order to facilitate removal of said target substance.

75. A method according to claim 67, wherein said step of applying a voltage comprises:

applying a plurality of voltages in a predetermined pattern with respect to time to a plurality of particular portions of said particular earth formation in order to utilize said piezoelectric property to apply variable mechanical stresses thereto in order to sequentially deform said plurality of particular portions of said particular earth formation and to evacuate fluid therefrom with a resulting peristaltic fluid pump action.

76. A method according to claim 67, wherein said step of applying a voltage comprises:

applying an alternating voltage to said at least one particular portion of said particular earth formation in order to utilize said piezoelectric property to apply mechanical stresses to said at least one portion of said particular earth formation to mechanically and electrically agitate said at least one particular portion of said particular earth formation to overcome cohesive forces between said particular earth formation and said target substance.

77. A method according to claim 67, further comprising:

(d) applying mechanical stress to said at least one portion of said particular earth formation in order to generate electrical voltages in accordance with said piezoelectric effect utilizing said piezoelectric property of said particular formation.

78. A method according to claim 67, wherein said resonant piezoelectric frequency is determined experimentally from an examination of said particular earth formation.

79. A method according to claim 67, wherein said resonant piezoelectric frequency is determined by optimization of extraction of said target substance from said particular earth formation.

80. A method of enhancing hydrocarbon production from an oil and/or gas wellbore which extends into at least one hydrocarbon bearing formation, comprising the method steps of:

(a) obtaining characterizing information pertaining to said at least one hydrocarbon bearing formation;

(b) utilizing said characterizing information in order to determine an optimum frequency of a converse piezoelectric effect energizing source which defines a piezoelectric frequency of excitation;

(c) providing a converse piezoelectric effect energy source;

(d) coupling said converse piezolectric effect energy source to said at least one hydrocarbon bearing formation;

(e) operating said converse piezoelectric effect energy source in accordance with said optimum frequency in order to stimulate a piezoelectric response in said at least one hydrocarbon bearing formation causing the production of hydrocarbons; and (f) producing hydrocarbons from said wellbore.

81. A method according to claim 80, further comprising:

(g) alternating said at least one operating attribute of said converse piezoelectric effect energy source with respect to time to enhance the production of hydrocarbon form said wellbore.

82. A method according to claim 80, further comprising:

(g) applying said converse piezoelectric effect energy source in a different manner to particular portions of said at least one hydrocarbon bearing formation in order to develop permeability gradientsto direct the flow of hydrocarbons.

83. A method according to claim 80, wherein said target substance comprises a hydrocarbon substance.

84. A method according to claim 80, wherein said particular earth formation comprises a subterranean earth formation.

85. A method according to claim 80, wherein said alternating energy source comprises an alternating voltage.

86. A method according to claim 80, wherein said mechanical stress which alters a permeability of said at least one earth formation.

87. A method according to claim 80, wherein said alternating voltage develops mechanical stress which generates a localized temperature increase in said at least one earth formation.

88. A method according to claim 80, further comprising:

(g) indentifying a resonant piezoelectric frequency associated with said at least one earth formation; and (h) in said step of applying an alternating energy source, applying an alternating vibration having a frequency which generally corresponds to said resonant piezoelectric frequency of said at least one earth formation.

89. A method according to claim 88, wherein said resonant piezoelectric frequency is determined experimentally from an examination of said at least one earth formation.

90. A method according to claim 88, wherein said resonant piezoelectric frequency is determined by optimization of extraction of said hydrocarbons from said at least one earth formation.

91. A method of enhancing the transport of a target substance in a particular earth formation, comprising the method steps of:

(a) identifying a particular earth formation having a piezoelectric property and which bears said target substance;

(b) applying mechanical stress to at least a particular portion of said particular earth formation, in order to develop electrical voltages in said particular portion of said particular earth formation through the piezoelectric stimulation of said particular earth formation, in order to facilitate removal of said target substance;

(c) utilizing at least one removal process in combination with said step of applying mechanical stress to transport at least a portion of said target substance away from said at least one particular portion of said particular earth formation; and (d) wherein said resonant piezoelectric frequency is determined from at least one of the following techniques:

(1) experimentally from an examination of said particular earth formation;

(2) by optimization of extraction of said target substrate from said particular earth formation.

92. A method according to claim 91, wherein said target substance comprises a hydrocarbon substance.

93. A method according to claim 91, wherein said particular earth formation comprises a subterranean earth formation.

94. A method according to claim 91, wherein said at least one removal process comprises at least one of the following:

(a) artificial lift of fluids from a wellbore;

(b) waterflood of at least said particular earth formation.

95. A method according to claim 91, wherein said mechanical stress alters a permeability of said at least one particular portion of said particular earth formation.

96. A method according to claim 91, wherein said mechanical stress develops a localized temperature increase in said at least one particular portion of said particular earth formation which alters a permeability of said at least one particular portion of said particular earth formation.

97. A method according to claim 96, further comprising:

(d) applying a voltage to at least a particular portion of said particular earth formation, in order to develop mechanical stress in said particular portion of said particular earth formation, utilizing said piezoelectric property, in order to facilitate removal of said target substance.

98. A method according to claim 97, wherein said step of applying a voltage comprises:

applying a plurality of voltages to a plurality of particular portions of said particular earth formation in order to develop a plurality of differing mechanical stresses in said particular earth formation which develop an enhanced permeability having a controllable directional orientation, utilizing said piezoelectric property, in order to facilitate removal of said target substance.

99. A method according to claim 97, wherein said step of applying a voltage comprises:

applying a plurality of voltages in a predetermined pattern with respect to time to a plurality of particular portions of said particular earth formation in order to utilize said piezoelectric property to apply variable mechanical stresses thereto in order to sequentially deform said plurality of particular portions of said particular earth formation and to evacuate fluid therefrom with a resulting peristaltic fluid pump action.

100. A method according to claim 97, wherein said step of applying a voltage comprises:

applying an alternating voltage to said at least one particular portion of said particular earth formation in order to utilize said piezoelectric property to apply mechanical stresses to said at least one portion of said particular earth formation to mechanically and electrically agitate said at least one particular portion of said particular earth formation to overcome cohesive forces between said particular earth formation and said target substance.

101. A method according to claim 91, further comprising:

(d) identifying a resonant piezoelectric frequency associated with said particular earth formation; and (e) in said step of applying a mechanical stress, applying an alternating mechanical stress having a frequency which generally corresponds to said resonant piezoelectric frequency of said particular earth formation.

* * * * *